US011975382B2

(12) United States Patent
Reinold et al.

(10) Patent No.: US 11,975,382 B2
(45) Date of Patent: May 7, 2024

(54) USE OF A PARTICULATE MATERIAL COMPRISING A PARTICLE-SHAPED SYNTHETIC AMORPHIC SILICON DIOXIDE AS AN ADDITIVE FOR A MOLDING MATERIAL MIXTURE, CORRESPONDING METHOD, MIXTURES, AND KITS

(71) Applicant: HÜTTENES-ALBERTUS Chemische Werke Gesellschaft mit beschränkter Haftung, Düsseldorf (DE)

(72) Inventors: Lukas Mirko Reinold, Hannover (DE); Christian Lustig, Düsseldorf (DE); René Vargovic, Wunstorf (DE); Edgar Müller, Langenhagen (DE)

(73) Assignee: HUTTENES-ALBERTUS Chemische Werke Gesellschaft mit beschränkter Haftung, Düsseldorf (DE)

( * ) Notice: Subject to any disclaimer, the term of this patent is extended or adjusted under 35 U.S.C. 154(b) by 64 days.

(21) Appl. No.: 17/609,090

(22) PCT Filed: May 14, 2020

(86) PCT No.: PCT/EP2020/063520
§ 371 (c)(1),
(2) Date: Nov. 5, 2021

(87) PCT Pub. No.: WO2020/229623
PCT Pub. Date: Nov. 19, 2020

(65) Prior Publication Data

US 2022/0226882 A1 Jul. 21, 2022

(30) Foreign Application Priority Data

May 16, 2019 (DE) ..... 102019113008.5

(51) Int. Cl.
*B22C 1/02* (2006.01)
*B22C 1/18* (2006.01)

(52) U.S. Cl.
CPC ..... *B22C 1/02* (2013.01); *B22C 1/188* (2013.01)

(58) Field of Classification Search
CPC ..... B22C 1/02; B22C 1/188
See application file for complete search history.

(56) References Cited

U.S. PATENT DOCUMENTS

2008/0099180 A1 5/2008 Weicker
2008/0314549 A1 12/2008 Gerlach
(Continued)

FOREIGN PATENT DOCUMENTS

DE 102006061876 7/2008
DE 102007045649 4/2009
(Continued)

OTHER PUBLICATIONS

Haanappel, V.A.C., et al., "Test methods for characterizing the flowability of inorganic core sand mixtures—core production with inorganic binder systems," Gießerei-Praxis, 4, 2018, p. 35-36.
(Continued)

*Primary Examiner* — Kevin P Kerns
*Assistant Examiner* — Steven S Ha
(74) *Attorney, Agent, or Firm* — DUANE MORRIS LLP; Gregory M. Lefkowitz; Brandon A. Chan

(57) ABSTRACT

What is described is the use of a particulate material comprising, as its sole constituent or as one of multiple constituents, a particulate synthetic amorphous silicon dioxide having a particle size distribution with a median in the range from 0.1 to 0.4 μm, determined by means of laser scattering, as additive for a molding material mixture at least comprising: a refractory mold base material having an AFS
(Continued)

Figure 1:
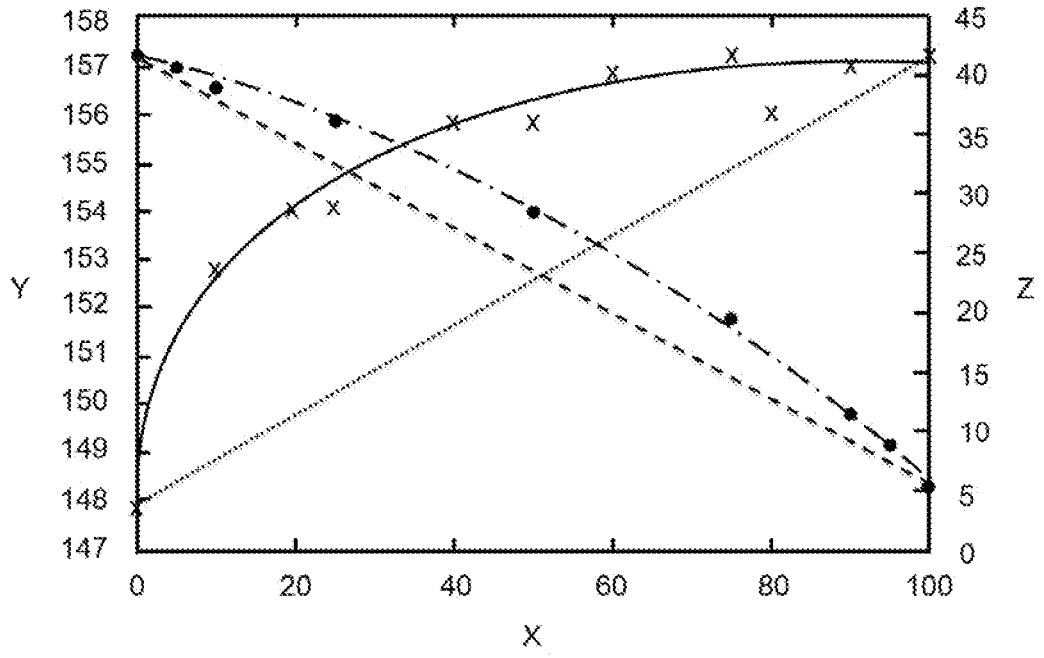

grain fineness number in the range from 30 to 100, particulate amorphous silicon dioxide having a particle size distribution with a median in the range from 0.7 to 1.5 μm, determined by means of laser scattering, and water glass, for increasing the moisture resistance of a molding producible by hot curing of the molding material mixture. Also described are corresponding processes, mixtures and kits.

19 Claims, 6 Drawing Sheets

(56) References Cited

U.S. PATENT DOCUMENTS

| | | | | |
|---|---|---|---|---|
| 2010/0326620 | A1 | 12/2010 | Mueller | |
| 2013/0264460 | A1 | 10/2013 | Yamao | |
| 2015/0246387 | A1 | 9/2015 | Bartels | |
| 2015/0315083 | A1* | 11/2015 | Deters | B22C 1/188 164/369 |
| 2016/0136724 | A1 | 5/2016 | Deters | |
| 2016/0361756 | A1 | 12/2016 | Deters | |
| 2017/0056963 | A1 | 3/2017 | Bartels | |
| 2020/0188988 | A1 | 6/2020 | Bach | |

FOREIGN PATENT DOCUMENTS

| | | |
|---|---|---|
| DE | 102012020510 | 4/2014 |
| DE | 102012020511 | 4/2014 |

OTHER PUBLICATIONS

Anonymous: "Elkem Microsilica 971", Internet Citation, Mar. 1, 2007, www.refractories .elkem.com/dav/3785eb7e24.pdf [Sep. 18, 2007].

* cited by examiner

USE OF A PARTICULATE MATERIAL COMPRISING A PARTICLE-SHAPED SYNTHETIC AMORPHIC SILICON DIOXIDE AS AN ADDITIVE FOR A MOLDING MATERIAL MIXTURE, CORRESPONDING METHOD, MIXTURES, AND KITS

CROSS-REFERENCE TO RELATED APPLICATIONS

This application is a § 371 national stage entry of International Application No. PCT/EP2020/063520, filed on May 14, 2020, which claims priority to German Patent Application No. 102019113008.5, filed on May 16, 2019, the entire contents of which are incorporated herein by reference.

The present invention relates to the use of a particulate material comprising, as its sole constituent or one of multiple constituents, a particulate synthetic amorphous silicon dioxide as additive for a molding material mixture for increasing the moisture resistance of a molding producible by hot curing of the molding material mixture. Further details of the use according to the invention will be apparent from the appended claims and the description that follows. The present invention additionally relates to a corresponding process for producing a hot-cured molding having elevated moisture resistance. The present invention additionally relates to a mixture and to the use thereof. The present invention further relates to a kit. Details of each will be apparent from the appended claims and the description that follows.

Casting in a lost mold is a widely used process for producing near-net-shape components. After the casting, the mold is destroyed, and the cast part is removed. Lost molds are casting molds and hence negatives; they contain the cavity to be cast that results in the finished cast part. The inner contours of the future casting are formed by cores. In the production of the casting mold, a model of the cast part to be manufactured forms the cavity in the molding material.

By contrast with sand casting methods in which the casting molds (lost molds) are destroyed after casting to remove the cast part, metallic permanent molds, manufactured from cast iron or steel for example, can be reutilized for the next casting after the cast part has been removed. It is also possible to work by diecasting, in which case the liquid metal melt is injected into a diecasting mold under high pressure at a high mold filling rate. The aforementioned casting methods are also preferred in the context of the present invention. Mold base materials used for casting molds (in sand casting methods with lost molds) and cores are predominantly refractory grainy substances, for example washed classified quartz sand. For production of the casting molds, the mold base materials are bound with inorganic or organic binders. The binder creates fixed coherence between the particles of the mold base material, such that the casting mold or core contains the requisite mechanical stability. The refractory mold base material premixed with the binder is preferably in a free-flowing form, such that it can be introduced into a suitable cavity and compacted therein. The molding materials are compacted in order to increase strength.

Casting molds and cores must fulfill various demands. During the actual casting operation, they must first have sufficient strength and thermal stability to be able to accommodate the liquid metal in the cavity formed from one or more (partial) casting molds. After the solidifying operation has commenced, the mechanical stability of the cast part is assured by a solidified metal layer that forms along the walls of the casting mold.

The material of the casting mold is then supposed to change under the influence of the heat released by the metal such that it loses its mechanical strength, i.e. the coherence between individual particles of refractory material is lost. In the ideal case, casting molds and cores break down again to form a fine sand that can be removed easily from the cast part and have correspondingly favorable breakdown properties.

Document DE 10 2013 111 626 A1 discloses a molding material mixture for production of molds or cores, at least comprising: a refractory mold base material, water glass as binder, particulate amorphous silicon dioxide and one or more pulverulent oxidic boron compounds. The document additionally discloses that the addition of boron compounds to the molding material mixture improves the moisture stability of the cores and molds produced therewith.

Document DE 10 2013 106 276 A1 discloses a molding material mixture for production of casting molds and cores for metal processing, comprising at least one refractory mold base material, particulate amorphous $SiO_2$, water glass and lithium compounds. The document additionally discloses that the addition of lithium compounds to the molding material mixture improves the moisture stability of the moldings produced therewith.

Document DE 10 2012 020 509 A1 discloses a molding material mixture for production of casting molds and cores for metal processing, comprising at least: a refractory mold base material, an inorganic binder and particulate amorphous $SiO_2$, producible by the thermal decomposition of $ZrSiO_4$ to give $ZrO_2$ and $SiO_2$.

Document DE 10 2012 020 510 A1 discloses a molding material mixture for production of casting molds and cores for metal processing, comprising at least a refractory mold base material, an inorganic binder and particulate amorphous $SiO_2$, producible by the oxidation of metallic silicon by means of an oxygenous gas.

Document DE 10 2012 020 511 A1 discloses a molding material mixture for production of casting molds and cores for metal processing, comprising at least a refractory mold base material, an inorganic binder and particulate amorphous $SiO_2$, producible by melting crystalline quartz and rapid recooling.

Document EP 1 802 409 B1 discloses a molding material mixture for producing casting molds for metal processing, at least comprising: a refractory mold base material, a water glass-based binder, characterized in that a proportion of a particulate synthetic amorphous silicon dioxide has been added to the molding material mixture.

Document WO2009/056320 A1 discloses a molding material mixture for production of casting molds for metal processing, at least comprising: a refractory mold base material; a water glass-based binder; a proportion of a particulate metal oxide selected from the group of silicon dioxide, aluminum oxide, titanium oxide and zinc oxide; a proportion of at least one surface-active substance has been added here to the molding material mixture.

The specialist article "Prüfmethoden zur Charakterisierung der Fließfähigkeit anorganischer Kernsandmischungen—Kernherstellung mit anorganischen Bindersystemen" [Test Methods for Characterizing the Flowability of Inorganic Core Sand Mixtures—Core Production with Inorganic Binder Systems] by the authors Haanappel and Morsink, published in the specialist journal "Gießerei-Praxis", 4, 2018, p. 35-36, discloses the use of surfactants and of pulverulent additives for improving the flowability of core sand mixtures.

The prior art thus already discloses molding material mixtures comprising particulate amorphous $SiO_2$. It is also known that particulate $SiO_2$ from $ZrO_2$ production can be used for molding material mixtures. It is additionally known that particulate $SiO_2$ formed in the reduction of quartz (for example with coke in an arc furnace) can be used for molding material mixtures. It is also known that, proceeding from particular base formulations, the addition of lithium or boron compounds can improve moisture stability (moisture resistance) of the moldings produced therewith.

Moreover, there is a need for molding material mixtures, the use of which can achieve maximum compaction and hence maximum relative molding weight (weight based on the volume of a given body of predetermined geometry; in the case of cores this is referred to as core weight). The use of casting cores having maximum core weight is advantageous since such cores lead to cast parts having fewer defects, better edge sharpness and higher surface quality.

More particularly, there is a need for molding material mixtures from which it is possible to produce moldings (casting molds or cores) that simultaneously have high relative molding weight (core weight in the case of cores) and good moisture stability.

More particularly, there is also a need for molding material mixtures from which it is possible to produce moldings (casting molds or cores) that simultaneously have high relative molding weight (core weight in the case of cores) and good moisture stability, and the constituents of which include extremely small amounts of lithium or boron compounds, if any.

The present invention relates, in its categories, to the inventive use of a particulate material, processes of the invention, mixtures of the invention, a kit of the invention, and the inventive use of a mixture. Embodiments, aspects and properties that are described in connection with one of these categories or described as preferred are each correspondingly or analogously applicable to the respective other categories, and vice versa.

Unless stated otherwise, preferred aspects or embodiments of the invention and their various categories can be combined with other aspects or embodiments of the invention and their various categories, especially with other preferred aspects or embodiments. The combination of respectively preferred aspects or embodiments with one another again results in each case in preferred aspects or embodiments of the invention.

In a primary aspect of the present invention, the above-specified objects and problems are achieved and solved by the use of a particulate material comprising, as its sole constituent or as one of multiple constituents, a particulate synthetic amorphous silicon dioxide having a particle size distribution with a median in the range from 0.1 to 0.4 μm, determined by means of laser scattering, as additive for a molding material mixture at least comprising:

- a refractory mold base material having an AFS grain fineness number in the range from 30 to 100,
- particulate amorphous silicon dioxide having a particle size distribution with a median in the range from 0.7 to 1.5 μm, determined by means of laser scattering, and
- water glass, for increasing the moisture resistance of a molding producible by hot curing of the molding material mixture.

A molding material mixture in the context of the present invention comprises refractory mold base material as one of multiple constituents.

The juncture of addition of the additive to the further constituents in production of the molding material mixture or of the molding material mixture provided with the additive is arbitrary and can be chosen freely. For example, the additive can be added last to the otherwise finished molding material mixture or can first be premixed with one or more of the constituents mentioned before one or more further constituents are finally mixed into the molding material mixture.

The term "particulate" refers to a solid powder (including dusts) or a granular material that is preferably pourable and hence also sievable.

The particulate material preferably comprises, as its sole constituent or as one of multiple constituents, a particulate synthetic amorphous silicon dioxide having a particle size distribution with a median in the range from 0.1 to 0.4 μm, determined by means of laser scattering.

Synthetically produced particulate amorphous silicon dioxide in the context of the present text means that the amorphous silicon dioxide is

- the target product of a planned chemical reaction process for industrial synthesis of amorphous silicon dioxide or

- a by-product of a planned chemical reaction process for industrial synthesis of a target product that is not amorphous silicon dioxide.

One example of a reaction process with amorphous silicon dioxide as its target product is the flame hydrolysis of silicon tetrachloride. The amorphous $SiO_2$ ("silicon dioxide") produced by this process is also referred to as "pyrogenic $SiO_2$" ("pyrogenic silicon dioxide") or as pyrogenic silica or as fumed silica (CAS RN 112945-52-5).

One example of a reaction process in which amorphous silicon dioxide is formed as a byproduct is the reduction of quartz with coke, for example, in an arc furnace for production of silicon or ferrosilicon as target product. The amorphous $SiO_2$ ("silicon dioxide") thus produced is also referred to as silica dust, silicon dioxide dust or $SiO_2$ fume condensate or as "silica fume" or microsilica (CAS RN 69012-64-2).

A further reaction process in which amorphous silicon dioxide is synthetically produced is the thermal decomposition of $ZrSiO_4$ with coke, for example, in an arc furnace to give ZrO and $SiO_2$.

The literature frequently refers to amorphous silicon dioxide formed by flame hydrolysis of silicon tetrachloride, to amorphous silicon dioxide formed as a by-product in the reduction of quartz with coke, for example, in an arc furnace, and to amorphous silicon dioxide formed by thermal decomposition of $ZrSiO_4$ as "pyrogenic $SiO_2$" ("pyrogenic silicon dioxide") or as pyrogenic silica. This terminology is also employed in the context of the present application.

In the context of the present invention, pyrogenic particulate amorphous silicon dioxide to be used with particular preference in the context of the present invention includes those types of particulate amorphous silicon dioxide that are identified by CAS RN 69012-64-2 and CAS RN 112945-52-5. These types of pyrogenic particulate amorphous silicon dioxide that are to be used with particular preference in accordance with the invention can be produced in a manner known per se, especially by reduction of quartz with carbon (e.g. coke) in an arc furnace with subsequent oxidation to silicon dioxide (preferably in the production of ferrosilicon and silicon). Likewise particularly preferred is $SiO_2$ prepared by thermal decomposition of $ZrSiO_4$ to give $ZrO_2$ from $ZrSiO_4$, and $SiO_2$ obtained by flame hydrolysis of silicon tetrachloride.

Particulate amorphous silicon dioxide of the type produced by reduction of quartz with carbon (e.g. coke) in an arc (in the production of ferrosilicon and silicon) contains carbon. Particulate amorphous silicon dioxide of the type produced by thermal decomposition of $ZrSiO_4$ contains zirconium dioxide.

Particulate synthetic amorphous silicon dioxide producible by oxidation of metallic silicon by means of an oxygenous gas and particulate synthetic amorphous silicon dioxide producible by quenching a silicon dioxide melt are very pure $SiO_2$ having only a very small number of unavoidable impurities.

Most preferably, the pyrogenic particulate amorphous silicon dioxide to be used with preference in accordance with the invention comprises particulate amorphous silicon dioxide of the type identified by CAS RN 69012-64-2. This is preferably produced by the reduction of quartz with carbon (e.g. coke) in an arc (for example in the production of ferrosilicon and silicon), or is obtained as a by-product (silica fume) in the production of ferrosilicon and silicon. Likewise particularly preferred is $SiO_2$ prepared by thermal decomposition of $ZrSiO_4$ to give $ZrO_2$ from $ZrSiO_4$. Particulate amorphous silicon dioxide of these types is also referred to as "microsilica" in the specialist field.

The "CAS RN" stands here for the CAS registry number and CAS register number (CAS=Chemical Abstracts Service).

The use of a particulate material comprising, as its sole constituent or as one of multiple constituents, a particulate synthetic amorphous silicon dioxide having a particle size distribution with a median in the range from 0.1 to 0.4 μm, determined by means of laser scattering, as additive for a molding material mixture means that the additive consists exclusively of particulate synthetic amorphous silicon dioxide having a particle size distribution with a median in the range from 0.1 to 0.4 μm, determined by means of laser scattering, or the additive comprises further particulate or non-particulate constituents in addition to the particulate synthetic amorphous silicon dioxide having a particle size distribution with a median in the range from 0.1 to 0.4 μm, determined by means of laser scattering. It is preferable when, aside from the particulate synthetic amorphous silicon dioxide having a particle size distribution with a median in the range from 0.1 to 0.4 μm, determined by means of laser scattering, the additive does not include any further particulate constituents that are a particulate synthetic amorphous silicon dioxide.

The median value of a particle size distribution is understood to mean the value at which half of the particle population examined has a smaller size than that value, while the other half of the particle population examined has a greater size than that value. This value is preferably ascertained as described further down in example 1.

What is meant (here and hereinafter) by "determined by means of light scattering" is that a sample of the particulate material to be examined—if required—is pretreated according to the method of example 1 (see below) and the particle size distribution of the material thus pretreated is then determined by means of laser scattering according to example 1 (see below).

The mold base material is preferably a refractory mold base material. In the present text, in accordance with the customary understanding of the person skilled in the art, "refractory" masses, materials and minerals refer to those that can at least briefly withstand the thermal stress in the course of casting or solidifying of an iron melt, usually cast iron. Suitable mold base materials are natural and synthetic mold base materials, for example quartz sand, zircon sand or chrome ore sand, olivine, vermiculite, bauxite or fireclay.

In the context of the present invention, the mold base material preferably accounts for more than 80% by weight, preferably more than 90% by weight, more preferably more than 95% by weight, of the total mass of the molding material mixture. The refractory mold base material is preferably in a free-flowing state. The mold base material to be used in accordance with the invention is accordingly preferably, and as usual, in grainy or particulate form.

The refractory mold base material has an AFS grain fineness number in the range from 30 to 100. The AFS grain fineness number is determined here according to VDG-Merkblatt (information sheet from the "Verein deutscher Gießereifachleute" [Society of German Foundry Experts]) P 34 of October 1999, point 5.2. The AFS grain fineness number is specified therein by the formula $$AFS - \text{Grain fineness number} = \frac{\sum g_i \times M3_i}{g}$$

Particulate amorphous silicon dioxide having a particle size distribution with a median in the range from 0.7 to 1.5 μm, determined by means of laser scattering, that may be used may be either synthetically produced or naturally occurring types. The latter are known, for example, from DE 10 2007 045 649, but they are not preferred since they frequently contain not inconsiderable crystalline components and are therefore classified as carcinogenic.

Water glass may be produced, for example, by dissolving vitreous sodium and potassium silicates in an autoclave or from lithium silicates in a hydrothermal process. According to the invention, it is possible to use water glass containing one, two or more of the alkali metal ions mentioned and/or containing one or additionally also one or more polyvalent cations, for example aluminum. The proportion of water glass in a molding material mixture in the context of the present invention is preferably in the range from 0.6% to 3% by weight.

What is meant (here and hereinafter) by "increasing moisture resistance" is that the molding produced in the case of inventive use, compared to a comparative molding which, with otherwise identical composition, geometry and mode of production, does not include any synthetic amorphous silicon dioxide having a particle size distribution with a median in the range from 0.1 to 0.4 μm, has improved moisture resistance (moisture stability) under the test conditions specified. For determination of moisture stability (moisture resistance) see example 4.

The term "hot curing" is understood to mean that the molding material mixture, in the course of curing, is subjected to temperatures exceeding 100° C., preferably temperatures of 100 to 300° C., more preferably temperatures of 120 to 250° C.

Hot curing can also be brought about or assisted by incidence of microwaves.

Hot curing can likewise be brought about or assisted by preferably uniform and more preferably also homogeneous passage of current or by preferably uniform and more preferably homogeneous application of an electromagnetic field through or to the formed molding material mixture.

This heats the molding material mixture, preferably uniformly, and hence cures it particularly homogeneously and ultimately in a high-quality manner. Details are disclosed in DE 10201721709863 (Wolfram Bach; Michael Kaftan) and the literature cited therein.

The heating of the molding material mixture for hot curing can be effected, for example, in a mold having temperatures exceeding 100° C., preferably temperatures of 100 to 300° C., more preferably temperatures of 120 to 250° C. The hot curing is preferably effected completely or at least partly in a customary mold for industrial production of moldings.

The molding material mixture can be cured here in suitable equipment and/or using suitable apparatus (such as conduits, pumps etc.) in which the hot curing is assisted by controlled aeration of the formed molding material mixture with ambient air at controlled temperature. The ambient air is preferably heated here to 100° C. to 250° C., more preferably to 110° C. to 180° C. Although this ambient air contains carbon dioxide, this in the context of the present invention does not correspond to curing by the $CO_2$ method, which requires the specific aeration of the molding material mixture with a $CO_2$-rich gas, especially in suitable equipment and/or using suitable apparatus (such as conduits, pumps etc.). What thus preferably does not take place here in the context of the hot curing envisaged in accordance with the invention or in combination therewith is aeration of the molding material mixture with a gas containing $CO_2$ in a concentration elevated relative to the concentration in air.

The flow rate and/or the volume flow of the ambient air at controlled temperature in the controlled aeration of the formed molding material mixture with ambient air at controlled temperature is/are preferably adjusted so as to cure the molding material mixture within periods of time that are preferred, but at least suitable, for an industrial application.

The periods of time for hot curing, i.e. the periods of time for the heating and controlled aeration of the formed molding material mixture with ambient air at controlled temperature, can be varied according to the requirements of the individual case and depend, for example, on the size and geometric characteristics of the molding material mixtures to be cured or of the molding to be cured.

Curing by hot curing within a period of less than 5 minutes is preferred in the context of the present invention; particular preference is given to curing within less than 2 minutes. In the case of very large moldings, according to the requirements of the individual case, however, longer periods of time may also be required.

The hot curing of a molding material mixture is effected by chemical reaction of constituents of the molding material mixture with one another, so as to result in the casting mold or core. The cause of the hot curing of a molding material mixture comprising a solution or dispersion comprising water glass is essentially the condensation of the water glass, i.e. the joining of the silicate units of the water glass to one another.

The hot curing of the molding material mixture does not require curing to be complete. The hot curing of the molding material mixture thus also includes incomplete curing of the molding material mixture. This corresponds to the understanding of the term "hot curing" by the person skilled in the art, since, for reasons of reaction kinetics, it cannot be expected that all the reactive constituents in the molding material mixture produced or provided will react within the quite short period of time of the hot curing operation. The person skilled in the art is aware in this respect, for example, of the phenomenon of post-curing of a molding material mixture (that has been hot-cured for example).

The molding material mixture may already have cured in the mold, but it is also possible to cure the molding material mixture only in its edge regions at first, such that it has sufficient strength to be taken from the mold. Subsequently, the molding material mixture can be cured further by removing further water (for example in a furnace or by evaporating the water under reduced pressure or in a microwave oven).

The inventive use is suitable for the production of all moldings customary for metal casting, i.e., for example, of cores and casting molds. It is also particularly advantageously possible to produce moldings having sections with very thin walls.

The moldings of the invention that are producible in the case of inventive use have particularly positive combinations of properties of comparatively high relative molding weight (weight based on the volume of a given body of predetermined geometry; this is referred to as core weight in the case of cores) and high moisture resistance (moisture stability). This comparatively high relative molding weight (core weight in the case of cores), according to in-house studies, is enabled and achieved by a positive synergistic effect on flowability and hence on compactibility and compaction of the molding material mixture in the case of the combination of the additive to be used in accordance with the invention (as defined above) with the particulate amorphous silicon dioxide having a particle size distribution with a median in the range from 0.7 to 1.5 μm that is likewise present. The present invention relates, with its various aspects that are collectively linked via a common technical teaching (use of a particulate material comprising, as its sole constituent or as one of multiple constituents, a particulate synthetic amorphous silicon dioxide having a particle size distribution with a median in the range from 0.1 to 0.4 μm, determined by means of laser scattering together with a particulate amorphous silicon dioxide having a particle size distribution with a median in the range from 0.7 to 1.5 μm, determined by means of laser scattering), to individual or all of the aforementioned objectives or needs.

The present invention also relates to a process for producing a hot-cured molding having elevated moisture resistance, having the following steps:

(i) producing a molding material mixture by mixing together at least the following constituents:
  refractory mold base material having an AFS grain fineness number in the range from 30 to 100,
  particulate amorphous silicon dioxide having a particle size distribution with a median in the range from 0.7 to 1.5 μm, determined by means of laser scattering, and
  water glass,
(ii) forming the molding material mixture,
(iii) hot curing the formed molding material mixture, so as to result in the molding, wherein the constituents of the molding material mixture are additionally mixed with a particulate material as additive comprising, as its sole constituent or as one of multiple constituents, a particulate synthetic amorphous silicon dioxide having a particle size distribution with a median in the range from 0.1 to 0.4 μm, determined by means of laser scattering.

The details relating to the inventive use and features thereof are correspondingly applicable.

Inventive commixing (at least) of the constituents of refractory mold base material (having an AFS grain fineness number in the range from 30 to 100), particulate amorphous silicon dioxide (having a particle size distribution with a median in the range from 0.7 to 1.5 micrometers, determined by means of laser scattering), water glass, and particulate material as additive (comprising, as its sole constituent or as one of multiple constituents, a particulate synthetic amorphous silicon dioxide having a particle size distribution with a median in the range from 0.1 to 0.4 μm, determined by means of laser scattering) results in a molding material mixture which is subsequently processed further (in step (ii)). The presence of further constituents during the mixing is not ruled out here.

The sequence of combination or addition of the individual constituents is arbitrary and can be chosen freely.

The forming of the molding material mixture (in step (ii)) is understood to mean that the molding material mixture or portions of the molding material mixture are converted to a defined outer shape. This can be accomplished, for example, in that the molding material mixture is introduced into a mold; more preferably, it means that the molding material mixture is introduced into a corresponding mold by means of compressed air.

The hot curing of the formed molding material mixture (in step (iii)) results in the molding. On account of the presence of the additive (particulate synthetic amorphous silicon dioxide having a particle size distribution with a median in the range from 0.1 to 0.4 μm, determined by means of laser scattering), this has elevated moisture resistance.

Preference is given to a process of the invention (as described above, preferably as identified as preferred above), wherein the molding material mixture is produced by creating a solid-state mixture or suspension by mixing at least the following solid constituents:

- particulate amorphous silicon dioxide having a particle size distribution with a median in the range from 0.7 to 1.5 μm, determined by means of laser scattering, and
- as additive, a particulate material comprising, as its sole constituent or as one of multiple constituents, a particulate synthetic amorphous silicon dioxide having a particle size distribution with a median in the range from 0.1 to 0.4 μm, determined by means of laser scattering, wherein the solid-state mixture or suspension created is mixed with the further constituents of the molding material mixture.

The particles of the solid constituents mentioned preferably differ not just by their particle size distribution but also in at least one further chemical and/or physical property (especially preferably chemical composition). The presence of one or more further components is not ruled out here, and likewise leads to a solid-state mixture of the invention.

For the purposes of the present invention, according to the requirements of the individual case, it is frequently advantageous to produce a solid-state mixture from particulate amorphous silicon dioxide having a particle size distribution with a median in the range from 0.7 to 1.5 μm (determined by means of laser scattering) with a particulate material comprising, as its sole constituent or as one of multiple constituents, a particulate synthetic amorphous silicon dioxide having a particle size distribution with a median in the range from 0.1 to 0.4 μm (determined by means of laser scattering).

What is meant by the mixing of the solid-state mixture thus created with the further constituents of the molding material mixture is that the solid-state mixture described is mixed at least with the constituents of refractory mold base material (having an AFS grain fineness number in the range from 30 to 100), particulate amorphous silicon dioxide (having a particle size distribution with a median in the range from 0.7 to 1.5 μm, determined by means of laser scattering), and water glass. This mixing results in a molding material mixture of the invention.

The invention also relates to a mixture of the invention for use in a process of the invention (as described above, preferably as identified above as preferred), at least comprising the following solid constituents:

- particulate amorphous silicon dioxide having a particle size distribution with a median in the range from 0.7 to 1.5 μm, determined by means of laser scattering, and
- as additive, a particulate material comprising, as its sole constituent or as one of multiple constituents, a particulate synthetic amorphous silicon dioxide having a particle size distribution with a median in the range from 0.1 to 0.4 μm, determined by means of laser scattering, wherein the mixture is a solid-state mixture or a suspension of solid constituents in a liquid carrier medium, preferably a solid-state mixture.

The mixture of the invention, when used in a process of the invention, contributes to an increase in moisture resistance of the hot-cured molding with simultaneously advantageously high relative molding weight (core weight in the case of cores).

The mixture of the invention may comprise further particulate and/or liquid substances. The mixture of the invention is preferably in the form of a suspension, i.e. of a heterogeneous mixture of a liquid and particles distributed therein, or of a solid-state mixture, i.e. without the presence of liquid substances.

Preference is given to a mixture of the invention (as described above, preferably as identified above as preferred), preferably a molding material mixture, at least comprising the following constituents:

- refractory mold base material having an AFS grain fineness number in the range from 30 to 100,
- particulate amorphous silicon dioxide having a particle size distribution with a median in the range from 0.7 to 1.5 μm, determined by means of laser scattering,
- water glass, and
- as additive, a particulate material comprising, as its sole constituent or as one of multiple constituents, a particulate synthetic amorphous silicon dioxide having a particle size distribution with a median in the range from 0.1 to 0.4 μm, determined by means of laser scattering.

Such a mixture of the invention can be used, by forming and subsequent hot curing of the formed mixture, to produce moldings having particularly high moisture resistance. This high moisture resistance arises without the presence of additives/ingredients typically used for this purpose. For example, it is known that the presence of particulate oxidic boron compounds or lithium ion-containing water glass can increase the moisture resistance of moldings. However, such substances must be introduced additionally and in many cases impair essential parameters of the moldings and of the cast parts formed therefrom, for example strength, core weight and (surface) quality of the cast part. The presence of such substances is thus undesirable in many cases, nor is it required in the mixture of the invention in order to obtain high moisture resistance. Further additives/ingredients from the group of the particulate oxidic boron compounds and/or the group of lithium-containing water glasses are therefore preferably absent in mixtures of the invention.

Preference is additionally given to a mixture (as described above, preferably as identified above as preferred), preferably a solid-state mixture, wherein, in the mixture, the proportion of particulate synthetic amorphous silicon dioxide having a particle size distribution with a median in the range from 0.1 to 0.4 μm, determined by means of laser scattering, is less than 2% by weight and preferably greater than 0.015% by weight, more preferably greater than 0.02% by weight, based on the total mass of the mixture, and/or the proportion of particulate amorphous silicon dioxide having a particle size distribution with a median in the range from 0.7 to 1.5 μm, determined by means of laser scattering, is less than 2% by weight and preferably greater than 0.015% by weight, more preferably greater than 0.02% by weight, based on the total mass of the mixture, and/or the total proportion of particulate synthetic amorphous silicon dioxide having a particle size distribution with a median in the range from 0.1 to 0.4 μm, determined by means of laser scattering, and particulate amorphous silicon dioxide having a particle size distribution with a median in the range from 0.7 to 1.5 μm, determined by means of laser scattering, is less than 2% by weight and preferably greater than 0.3% by weight, based on the total mass of the mixture, and/or the total proportion of amorphous silicon dioxide is less than 2% by weight and preferably greater than 0.3% by weight, based on the total mass of the mixture.

According to the requirements of the individual case, it may be preferable to restrict the proportions of amorphous silicon dioxide (overall or with the above-defined particle size distributions) as specified, in order to obtain particularly favorable combinations of properties. Here too, the particle size distribution or the respective median of the particle size distribution is determined by means of laser scattering as described in example 1.

Preference is additionally given to a mixture, preferably a molding material mixture (as described above, preferably as identified above as preferred), producible by a process comprising the following steps:

(i) providing or producing a separate amount of a particulate amorphous silicon dioxide having a particle size distribution with a median in the range from 0.7 to 1.5 μm, determined by means of laser scattering, (ii) providing or producing an amount of a particulate material comprising, as its sole constituent or as one of multiple constituents, a particulate synthetic amorphous silicon dioxide having a particle size distribution with a median in the range from 0.1 to 0.4 μm, determined by means of laser scattering, (iii) mixing the amounts provided or produced in steps (i) and (ii).

Such a preferred (molding material) mixture of the invention thus comprises two types of particulate amorphous silicon dioxide that are mixed with one another.

Preference is given to a mixture (as described above, preferably as identified above as preferred), wherein the ratio of the total mass of particulate amorphous silicon dioxide having a particle size distribution with a median in the range from 0.7 to 1.5 μm, determined by means of laser scattering, to the total mass of particulate synthetic amorphous silicon dioxide having a particle size distribution with a median in the range from 0.1 to 0.4 μm, determined by means of laser scattering, is in the range from 20:1 to 1:20, preferably in the range from 5:1 to 1:20, more preferably in the range from 3:1 to 1:20, especially preferably in the range from 2:1 to 1:20, most preferably in the range from 1.5:1 to 1:20.

Within this preferred range, moisture stability is increased to a particular degree without specific disadvantages in terms of core weight. Outside this range, this effect is less marked.

Preference is given respectively to a use of the invention (as described above, preferably as identified above as preferred), a process of the invention (as described above, preferably as identified above as preferred) and to a mixture of the invention (as described above, preferably as identified above as preferred), wherein the particulate synthetic amorphous silicon dioxide having a particle size distribution with a median in the range from 0.1 to 0.4 μm, determined by means of laser scattering, and/or the particulate amorphous silicon dioxide having a particle size distribution with a median in the range from 0.7 to 1.5 μm, determined by means of laser scattering, is selected or are independently selected from the group consisting of particulate synthetic amorphous silicon dioxide containing silicon dioxide in a proportion of at least 90% by weight, based on the total mass of the particulate synthetic amorphous silicon dioxide, and at least carbon as secondary constituent, preferably producible by reducing quartz in an arc furnace;

particulate synthetic amorphous silicon dioxide comprising oxidic zirconium as secondary constituent and preferably producible by thermal decomposition of $ZrSiO_4$ particulate synthetic amorphous silicon dioxide producible by oxidizing metallic silicon by means of an oxygenous gas;

particulate synthetic amorphous silicon dioxide producible by quenching a silicon dioxide melt and mixtures thereof.

The configurations set out in aspects 14, 15 and 16 below are likewise preferred here.

The fact that the species are selected from particulate amorphous silicon dioxide and are selected independently means that the two species come from different groups or else each come from the same group. It is thus possible for the two species of particulate amorphous silicon dioxide to be selected such that they are chemically different and have a different size distribution. Alternatively, both species may be selected such that they merely have different size distributions with identical chemical composition.

The effects and advantages set out above in connection with uses of the invention, processes of the invention and mixtures of the invention are achieved here to a particular degree.

Preference is given respectively to a use of the invention (as described above, preferably as identified above as preferred), a process of the invention (as described above, preferably as identified above as preferred) and to a mixture of the invention (as described above, preferably as identified above as preferred), wherein the particulate synthetic amorphous silicon dioxide having a particle size distribution with a median in the range from 0.1 to 0.4 μm, determined by means of laser scattering, contains silicon dioxide in a proportion of at least 90% by weight based on the total mass of the particulate synthetic amorphous silicon dioxide, and at least carbon as secondary constituent, and is preferably producible by reducing quartz in an arc furnace;

and/or the particulate amorphous silicon dioxide having a particle size distribution with a median in the range from 0.7 to 1.5 μm, determined by means of laser scattering, is a particulate synthetic amorphous silicon dioxide comprising oxidic zirconium as secondary constituent and preferably producible by thermal decomposition of $ZrSiO_4$.

This means that, in a use of the invention (as described above, preferably as identified above as preferred), a process of the invention (as described above, preferably as identified above as preferred) or a mixture of the invention (as described above, preferably as identified above as preferred), either both the specified species of the amorphous silicon dioxide are selected as described or just one species is selected as described.

The effects and advantages set out above in connection with a use of the invention, a process of the invention or a mixture of the invention are achieved here to a particular degree.

Preference is given to a use of the invention (as described above, preferably as identified above as preferred), a process of the invention (as described above, preferably as identified above as preferred) and a mixture of the invention (as described above, preferably as identified above as preferred), wherein one or more constituents have been added to the molding material mixture or mixture or are selected from the group consisting of: barium sulfate, oxidic boron compounds, graphite, carbohydrates, lithium compounds, phosphorus compounds, hollow microbeads, molybdenum sulfide, lubricants in platelet form, surfactants, organosilicon compounds, alumina and alumina-containing compounds.

The advantages of the use of one or more constituents of the group mentioned that are known to the person skilled in the art can be combined in a use of the invention, a process of the invention or a mixture of the invention having elevated moisture resistance of the molding that results or can be produced from the use of the invention, the process of the invention or the mixture of the invention.

The effects and advantages set out above in connection with uses of the invention, processes of the invention or mixtures of the invention are achieved here to a particular degree.

Preference is also given to a use of the invention (as described above, preferably as identified above as preferred), a process of the invention (as described above, preferably as identified above as preferred) and to a mixture of the invention (as described above, preferably as identified above as preferred), wherein the particulate synthetic amorphous silicon dioxide having a particle size distribution with a median in the range from 0.1 to 0.4 μm, determined by means of laser scattering, and/or the particulate amorphous silicon dioxide having a particle size distribution with a median in the range from 0.7 to 1.5 μm, determined by means of laser scattering, has pozzolanic activity.

When the particulate synthetic amorphous silicon dioxide having a particle size distribution with a median in the range from 0.1 to 0.4 μm or the particulate amorphous silicon dioxide having a particle size distribution with a median in the range from 0.7 to 1.5 μm have pozzolanic activity, they are capable of reacting with calcium hydroxide in the presence of water.

It is preferable that both the particulate synthetic amorphous silicon dioxide having a particle size distribution with a median in the range from 0.1 to 0.4 μm and the particulate amorphous silicon dioxide having a particle size distribution with a median in the range from 0.7 to 1.5 μm have pozzolanic activity.

Preference is given to a use of the invention (as described above, preferably as identified above as preferred), a process of the invention (as described above, preferably as identified above as preferred) and to a mixture of the invention (as described above, preferably as identified above as preferred), wherein the activity of Ra226 in the molding material mixture or mixture is not more than 1 Bq/g.

The use of (molding material) mixtures having higher activity is increasingly being perceived as unacceptable.

The activity is preferably measured by means of gamma spectrometry according to ISO 19581:2017.

Preference is also given to a kit for producing a mixture (as described above, preferably as identified above as preferred), at least comprising as or in a first constituent of the kit, an amount of particulate amorphous silicon dioxide having a particle size distribution with a median in the range from 0.7 to 1.5 μm, determined by means of laser scattering, as or in a second constituent of the kit, an amount of particulate synthetic amorphous silicon dioxide having a particle size distribution with a median in the range from 0.1 to 0.4 μm, determined by means of laser scattering, wherein the first and second constituents of the kit are arranged in spatial separation from one another.

Preference is given to using the kit of the invention for producing a mixture of the invention according to one of aspects 4, 6, 8, 10, 12, 16, 19, 22 or 28 below or for performing a process of the invention according to one of aspects 2, 3, 15, 18, 21 or 24 below.

The effects and advantages set out above in connection with uses of the invention, processes of the invention or mixtures of the invention are achieved here too.

Preference is given to the use of a mixture (as described above, preferably as identified above as preferred) in the production of casting molds or cores for metal processing. Cores produced in this way are then preferably used in exterior parts of molds selected from the group consisting of metallic permanent molds (e.g. diecasting molds) and lost molds (e.g. sand molds).

The effects and advantages set out above in connection with uses of the inventions and mixtures of the invention are achieved here too.

Preferred aspects of the present invention are specified hereinafter.

1. The use of a particulate material comprising, as its sole constituent or as one of multiple constituents, a particulate synthetic amorphous silicon dioxide having a particle size distribution with a median in the range from 0.1 to 0.4 μm, determined by means of laser scattering, as additive for a molding material mixture at least comprising:

a refractory mold base material having an AFS grain fineness number in the range from 30 to 100, particulate amorphous silicon dioxide having a particle size distribution with a median in the range from 0.7 to 1.5 μm, determined by means of laser scattering, and water glass, for increasing the moisture resistance of a molding producible by hot curing of the molding material mixture.

2. A process for producing a hot-cured molding having increased moisture resistance, having the following steps:

(i) producing a molding material mixture by mixing together at least the following constituents:

refractory mold base material having an AFS grain fineness number in the range from 30 to 100, particulate amorphous silicon dioxide having a particle size distribution with a median in the range from 0.7 to 1.5 μm, determined by means of laser scattering, and water glass, (ii) forming the molding material mixture, (iii) hot curing the formed molding material mixture, so as to result in the molding, wherein the constituents of the molding material mixture are additionally mixed with a particulate material as additive comprising, as its sole constituent or as one of multiple constituents, a particulate synthetic amorphous silicon dioxide having a particle size distribution with a median in the range from 0.1 to 0.4 μm, determined by means of laser scattering.

3. The process according to aspect 2, wherein the molding material mixture is produced by creating a solid-state mixture by mixing at least the following solid constituents:

particulate amorphous silicon dioxide having a particle size distribution with a median in the range from 0.7 to 1.5 μm, determined by means of laser scattering, and as additive, a particulate material comprising, as its sole constituent or as one of multiple constituents, a particulate synthetic amorphous silicon dioxide having a particle size distribution with a median in the range from 0.1 to 0.4 μm, determined by means of laser scattering, wherein the solid-state mixture created is mixed with the further constituents of the molding material mixture.

4. A mixture for use in a process according to either of aspects 2 and 3, at least comprising the following solid constituents:

particulate amorphous silicon dioxide having a particle size distribution with a median in the range from 0.7 to 1.5 μm, determined by means of laser scattering, and as additive, a particulate material comprising, as its sole constituent or as one of multiple constituents, a particulate synthetic amorphous silicon dioxide having a particle size distribution with a median in the range from 0.1 to 0.4 μm, determined by means of laser scattering, wherein the mixture is a solid-state mixture or a suspension of solid constituents in a liquid carrier medium, preferably a solid-state mixture.

5. A process for producing a mixture according to aspect 4, having the following steps:

(i) producing or providing particulate amorphous silicon dioxide having a particle size distribution with a median in the range from 0.7 to 1.5 μm, determined by means of laser scattering, as a pure substance or as a constituent of a solid-state mixture or as a constituent of a suspension of solid constituents in a liquid carrier medium, and separately (ii) producing or providing particulate material comprising, as its sole constituent or as one of multiple constituents, a particulate synthetic amorphous silicon dioxide having a particle size distribution with a median in the range from 0.1 to 0.4 μm, determined by means of laser scattering, as a pure substance or as a constituent of a solid-state mixture or as a constituent of a suspension of solid constituents in a liquid carrier medium, and then (iii) mixing the substances produced or provided in steps (i) to (ii) (each independently pure substances, solid-state mixtures or suspensions).

6. The mixture according to aspect 4, preferably molding material mixture for production of a molding, at least comprising the following constituents:

refractory mold base material having an AFS grain fineness number in the range from 30 to 100, particulate amorphous silicon dioxide having a particle size distribution with a median in the range from 0.7 to 1.5 μm, determined by means of laser scattering, water glass, and as additive, a particulate material comprising, as its sole constituent or as one of multiple constituents, a particulate synthetic amorphous silicon dioxide having a particle size distribution with a median in the range from 0.1 to 0.4 μm, determined by means of laser scattering.

7. A process for producing a mixture according to aspect 6, having the following steps:

(i) producing or (preferably) providing particulate amorphous silicon dioxide having a particle size distribution with a median in the range from 0.7 to 1.5 μm, determined by means of laser scattering, as a pure substance or as a constituent of a solid-state mixture or as a constituent of a suspension of solid constituents in a liquid carrier medium, (ii) producing or (preferably) providing particulate material comprising, as its sole constituent or as one of multiple constituents, a particulate synthetic amorphous silicon dioxide having a particle size distribution with a median in the range from 0.1 to 0.4 μm, determined by means of laser scattering, as a pure substance or as a constituent of a solid-state mixture or as a constituent of a suspension of solid constituents in a liquid carrier medium, (iii) producing or (preferably) providing a refractory mold base material having an AFS grain fineness number in the range from 30 to 100, (iv) producing or (preferably) providing water glass, (v) mixing the substances produced or provided in steps (i) to (iv) (preferably, the substances produced or provided in steps (i) and (ii) are first mixed with one another, and only then is the resulting preliminary mixture mixed with the further substances).

8. The mixture, preferably molding material mixture, according to aspect 6, wherein, in the mixture, the proportion of particulate synthetic amorphous silicon dioxide having a particle size distribution with a median in the range from 0.1 to 0.4 μm, determined by means of laser scattering, is less than 2% by weight and preferably greater than 0.015% by weight, more preferably greater than 0.02% by weight, based on the total mass of the mixture, and/or the proportion of particulate amorphous silicon dioxide having a particle size distribution with a median in the range from 0.7 to 1.5 μm, determined by means of laser scattering, is less than 2% by weight and preferably greater than 0.015% by weight, more preferably greater than 0.02% by weight, based on the total mass of the mixture, and/or the total proportion of particulate synthetic amorphous silicon dioxide having a particle size distribution with a median in the range from 0.1 to 0.4 μm, determined by means of laser scattering, and particulate amorphous silicon dioxide having a particle size distribution with a median in the range from 0.7 to 1.5 μm, determined by means of laser scattering, is less than 2% by weight and preferably greater than 0.3% by weight, based on the total mass of the mixture, and/or the total proportion of amorphous silicon dioxide is less than 2% by weight and preferably greater than 0.3% by weight, based on the total mass of the mixture.

9. A process for producing a mixture according to aspect 8, having the following steps:
   (i) producing or providing particulate amorphous silicon dioxide having a particle size distribution with a median in the range from 0.7 to 1.5 μm, determined by means of laser scattering, as a constituent of a solid-state mixture or as a constituent of a suspension of solid constituents in a liquid carrier medium,
   (ii) producing or providing particulate synthetic amorphous silicon dioxide having a particle size distribution with a median in the range from 0.1 to 0.4 μm, determined by means of laser scattering, as a constituent of a solid-state mixture or as a constituent of a suspension of solid constituents in a liquid carrier medium,
   (iii) producing a providing further liquid or particulate substances or substance mixtures,
   (iv) mixing the constituents produced or provided in steps (i) to (iii) in the corresponding amounts (cf. aspect 6).

10. The mixture, preferably molding material mixture, according to any of the preceding aspects 4, 6 and 8, producible by a process comprising the following steps:
   (i) providing or producing a separate amount of a particulate amorphous silicon dioxide having a particle size distribution with a median in the range from 0.7 to 1.5 μm, determined by means of laser scattering,
   (ii) providing or producing an amount of a particulate material comprising, as its sole constituent or as one of multiple constituents, a particulate synthetic amorphous silicon dioxide having a particle size distribution with a median in the range from 0.1 to 0.4 μm, determined by means of laser scattering,
   (iii) mixing the amounts provided or produced in steps (i) and (ii), preferably producible by a process according to any of aspects 5, 7 and 9.

11. A process for producing a mixture according to any of aspects 4, 6, 8 or 10, having the following steps:
   (i) providing or producing a separate amount of a particulate amorphous silicon dioxide having a particle size distribution with a median in the range from 0.7 to 1.5 μm, determined by means of laser scattering,
   (ii) providing or producing an amount of a particulate material comprising, as its sole constituent or as one of multiple constituents, a particulate synthetic amorphous silicon dioxide having a particle size distribution with a median in the range from 0.1 to 0.4 μm, determined by means of laser scattering,
   (iii) mixing the amounts provided or produced in steps (i) and (ii).

12. The mixture according to any of aspects 4, 6, 8 or 10, wherein the ratio of the total mass of particulate amorphous silicon dioxide having a particle size distribution with a median in the range from 0.7 to 1.5 μm, determined by means of laser scattering, to the total mass of particulate synthetic amorphous silicon dioxide having a particle size distribution with a median in the range from 0.1 to 0.4 μm, determined by means of laser scattering, is in the range from 20:1 to 1:20, preferably in the range from 5:1 to 1:20, more preferably in the range from 3:1 to 1:20, especially preferably in the range from 2:1 to 1:20, most preferably in the range from 1.5:1 to 1:20.

13. A process for producing a mixture according to any of aspects 4, 6, 8 or 10, having the following steps:
   (i) providing or producing an amount of a particulate material comprising, as its sole constituent or as one of multiple constituents, a particulate synthetic amorphous silicon dioxide having a particle size distribution with a median in the range from 0.1 to 0.4 μm, determined by means of laser scattering, as a constituent of a solid-state mixture or as a constituent of a suspension of solid constituents in a liquid carrier medium,
   (ii) providing or producing a separate amount of a particulate amorphous silicon dioxide having a particle size distribution with a median in the range from 0.7 to 1.5 μm, determined by means of laser scattering, as a constituent of a solid-state mixture or as a constituent of a suspension of solid constituents in a liquid carrier medium,
   (iii) mixing amounts of the substances produced or provided in steps (i) to (ii), where the amounts of the substances are chosen such that, in the resulting mixture, the total mass of particulate amorphous silicon dioxide having a particle size distribution with a median in the range from 0.7 to 1.5 μm, determined by means of laser scattering, to the total mass of particulate synthetic amorphous silicon dioxide having a particle size distribution with a median in the range from 0.1 to 0.4 μm, determined by means of laser scattering, is in the range from 20:1 to 1:20, preferably in the range from 5:1 to 1:20, more preferably in the range from 3:1 to 1:20, especially preferably in the range from 2:1 to 1:20, most preferably in the range from 1.5:1 to 1:20.

14. The use according to aspect 1, wherein the particulate synthetic amorphous silicon dioxide having a particle size distribution with a median in the range from 0.1 to 0.4 μm, determined by means of laser scattering, and/or the particulate amorphous silicon dioxide having a particle size distribution with a median in the range from 0.7 to 1.5 μm, determined by means of laser scattering, is selected or are independently selected from the group consisting of particulate synthetic amorphous silicon dioxide containing silicon dioxide in a proportion of at least 90% by weight, based on the total mass of the particulate synthetic amorphous silicon dioxide, and at least carbon as secondary constituent, preferably produced by reducing quartz in an arc furnace (where it is typically obtained as a by-product);

particulate synthetic amorphous silicon dioxide comprising oxidic zirconium as secondary constituent and preferably produced by thermal decomposition of $ZrSiO_4$ particulate synthetic amorphous silicon dioxide produced by oxidizing metallic silicon by means of an oxygenous gas;

particulate synthetic amorphous silicon dioxide produced by quenching a silicon dioxide melt and mixtures thereof.

15. The process according to either of aspects 2 and 3, wherein the particulate synthetic amorphous silicon dioxide having a particle size distribution with a median in the range from 0.1 to 0.4 μm, determined by means of laser scattering, and/or the particulate amorphous silicon dioxide having a particle size distribution with a median in the range from 0.7 to 1.5 μm, determined by means of laser scattering, is selected or are independently selected from the group consisting of particulate synthetic amorphous silicon dioxide containing silicon dioxide in a proportion of at least 90% by weight, based on the total mass of the particulate synthetic amorphous silicon dioxide, and at least carbon as secondary constituent, preferably produced by reducing quartz in an arc furnace;

particulate synthetic amorphous silicon dioxide comprising oxidic zirconium as secondary constituent and preferably produced by thermal decomposition of $ZrSiO_4$ particulate synthetic amorphous silicon dioxide produced by oxidizing metallic silicon by means of an oxygenous gas;

particulate synthetic amorphous silicon dioxide produced by quenching a silicon dioxide melt and mixtures thereof.

16. The mixture according to any of aspects 4, 6, 8, 10 or 12, the particulate synthetic amorphous silicon dioxide having a particle size distribution with a median in the range from 0.1 to 0.4 μm, determined by means of laser scattering, and/or the particulate amorphous silicon dioxide having a particle size distribution with a median in the range from 0.7 to 1.5 μm, determined by means of laser scattering, is selected or are independently selected from the group consisting of particulate synthetic amorphous silicon dioxide containing silicon dioxide in a proportion of at least 90% by weight, based on the total mass of the particulate synthetic amorphous silicon dioxide, and at least carbon as secondary constituent, preferably producible by reducing quartz in an arc furnace;

particulate synthetic amorphous silicon dioxide comprising oxidic zirconium as secondary constituent and preferably producible by thermal decomposition of $ZrSiO_4$ particulate synthetic amorphous silicon dioxide producible by oxidizing metallic silicon by means of an oxygenous gas;

particulate synthetic amorphous silicon dioxide producible by quenching a silicon dioxide melt and mixtures thereof.

17. The process according to any of aspects 1 or 14, wherein the particulate synthetic amorphous silicon dioxide having a particle size distribution with a median in the range from 0.1 to 0.4 μm, determined by means of laser scattering, contains silicon dioxide in a proportion of at least 90% by weight based on the total mass of the particulate synthetic amorphous silicon dioxide, and at least carbon as secondary constituent, and is preferably produced by reducing quartz in an arc furnace;

and/or the particulate amorphous silicon dioxide having a particle size distribution with a median in the range from 0.7 to 1.5 μm, determined by means of laser scattering, is a particulate synthetic amorphous silicon dioxide comprising oxidic zirconium as secondary constituent and preferably produced by thermal decomposition of $ZrSiO_4$.

18. The process according to any of aspects 2, 3 or 15, wherein the particulate synthetic amorphous silicon dioxide having a particle size distribution with a median in the range from 0.1 to 0.4 μm, determined by means of laser scattering, contains silicon dioxide in a proportion of at least 90% by weight based on the total mass of the particulate synthetic amorphous silicon dioxide, and at least carbon as secondary constituent, and is preferably produced by reducing quartz in an arc furnace;

and/or the particulate amorphous silicon dioxide having a particle size distribution with a median in the range from 0.7 to 1.5 μm, determined by means of laser scattering, is a particulate synthetic amorphous silicon dioxide comprising oxidic zirconium as secondary constituent and preferably produced by thermal decomposition of $ZrSiO_4$.

19. The mixture according to any of aspects 4, 6, 8, 10, 12 or 16, the particulate synthetic amorphous silicon dioxide having a particle size distribution with a median in the range from 0.1 to 0.4 μm, determined by means of laser scattering, contains silicon dioxide in a proportion of at least 90% by weight based on the total mass of the particulate synthetic amorphous silicon dioxide, and at least carbon as secondary constituent, and is preferably producible by reducing quartz in an arc furnace;

and/or the particulate amorphous silicon dioxide having a particle size distribution with a median in the range from 0.7 to 1.5 μm, determined by means of laser scattering, is a particulate synthetic amorphous silicon dioxide comprising oxidic zirconium as secondary constituent and preferably producible by thermal decomposition of $ZrSiO_4$.

20. The use according to any of aspects 1, 14 or 17, wherein one or more constituents have been added to the molding material mixture that are selected from the group consisting of: barium sulfate, oxidic boron compounds, graphite, carbohydrates, lithium compounds, phosphorus compounds, hollow microbeads, molybdenum sulfide, lubricants in platelet form, surfactants, organosilicon compounds, alumina and alumina-containing compounds.

21. The process according to any of aspects 2, 3, 15 or 18, wherein one or more constituents are added to the molding material mixture that are selected from the group consisting of: barium sulfate, oxidic boron compounds, graphite, carbohydrates, lithium compounds, phosphorus compounds, hollow microbeads, molybdenum sulfide, lubricants in platelet form, surfactants, organosilicon compounds, alumina and alumina-containing compounds.

22. The mixture according to any of aspects 4, 6, 8, 10, 12, 16 or 19, wherein one or more constituents have been added to the mixture that are selected from the group consisting of: barium sulfate, oxidic boron compounds, graphite, carbohydrates, lithium compounds, phosphorus compounds, hollow microbeads, molybdenum sulfide, lubricants in platelet form, surfactants, organosilicon compounds, alumina and alumina-containing compounds.

23. The process according to any of aspects 1, 14, 17 or 20, wherein the particulate synthetic amorphous silicon dioxide having a particle size distribution with a median in the range from 0.1 to 0.4 μm, determined by means of laser scattering, and/or the particulate amorphous silicon dioxide having a particle size distribution with a median in the range from 0.7 to 1.5 μm, determined by means of laser scattering,

10 has pozzolanic activity.

24. The mixture according to any of aspects 2, 3, 15, 18 or 21, wherein the particulate synthetic amorphous silicon dioxide having a particle size distribution with a median in the range from 0.1 to 0.4 μm, determined by means of laser scattering, and/or the particulate amorphous silicon dioxide having a particle size distribution with a median in the range from 0.7 to 1.5 μm, determined by means of laser scattering, has pozzolanic activity.

25. The mixture according to any of the preceding aspects 4, 6, 8, 10, 12, 16, 19 or 22, wherein the particulate synthetic amorphous silicon dioxide having a particle size distribution with a median in the range from 0.1 to 0.4 μm, determined by means of laser scattering, and/or the particulate amorphous silicon dioxide having a particle size distribution with a median in the range from 0.7 to 1.5 μm, determined by means of laser scattering, has pozzolanic activity.

26. The use according to any of aspects 1, 14, 17, 20 or 23, wherein the activity of Ra226 in the molding material mixture is not more than 1 Bq/g.

27. The process according to any of aspects 2, 3, 15, 18, 21, wherein the activity of Ra226 in the molding material mixture is not more than 1 Bq/g.

28. The mixture according to any of the preceding aspects 4, 6, 8, 10, 12, 16, 19 or 22, wherein the activity of Ra226 in the mixture is not more than 1 Bq/g.

29. A kit for producing a mixture according to any of the preceding aspects 4, 6, 8, 10, 12, 16, 19, 22 or 28 or for performing a process according to any of aspects 2, 3, 15, 18, 21 or 24, at least comprising as or in a first constituent of the kit, an amount of particulate amorphous silicon dioxide having a particle size distribution with a median in the range from 0.7 to 1.5 μm, determined by means of laser scattering, as or in a second constituent of the kit, an amount of particulate synthetic amorphous silicon dioxide having a particle size distribution with a median in the range from 0.1 to 0.4 μm, determined by means of laser scattering, wherein the first and second constituents of the kit are arranged in spatial separation from one another.

30. The use of a mixture according to any of the preceding aspects 4, 6, 8, 10, 12, 16, 19, 22 or 29 in the production of casting molds or cores for metal processing, wherein cores produced are preferably used in exterior parts of molds that are selected from the group consisting of metallic permanent molds (e.g. diecasting molds) and lost molds (e.g. sand molds).

Preference is given to uses, mixtures and processes of the invention in which the particulate synthetic amorphous silicon dioxide having a particle size distribution with a median in the range from 0.1 to 0.4 μm, determined by means of laser scattering, and the particulate amorphous silicon dioxide having a particle size distribution with a median in the range from 0.7 to 1.5 μm, determined by means of laser scattering, have a different chemical composition.

FIGURES

FIG. 1 shows results of the determination of the core weight of test bars (cf. example 3) and results of the determination of the moisture resistance of test bars (cf. example 4).

The X axis indicates the proportion of RW filler sieved in the total amount of RW filler sieved and RW filler Q1 Plus in the molding material mixture in percent. The Y axis indicates the core weight determined according to example 3 in grams. The Z axis indicates the moisture resistance determined according to example 4 in percent.

The filled circles indicate experimentally ascertained measurements of the core weight of test bars (according to example 3). The dashed-and-dotted line schematically illustrates the progression of the measurement points. The dashed line illustrates the linear correlation expected by the person skilled in the art between the proportion of RW filler sieved in the total amount of RW filler sieved and RW filler Q1 Plus in the molding material mixture and core weight (linear combination based on the values for the pure materials).

The crosses indicate experimentally ascertained measurements of the moisture resistance of test bars (according to example 4). The solid line schematically illustrates the progression of the measurement points. The dotted line illustrates the linear correlation expected by the person skilled in the art between the proportion of RW filler sieved in the total amount of RW filler sieved and RW filler Q1 Plus in the molding material mixture and the moisture resistance (linear combination based on the values for the pure materials).

Figure 2:
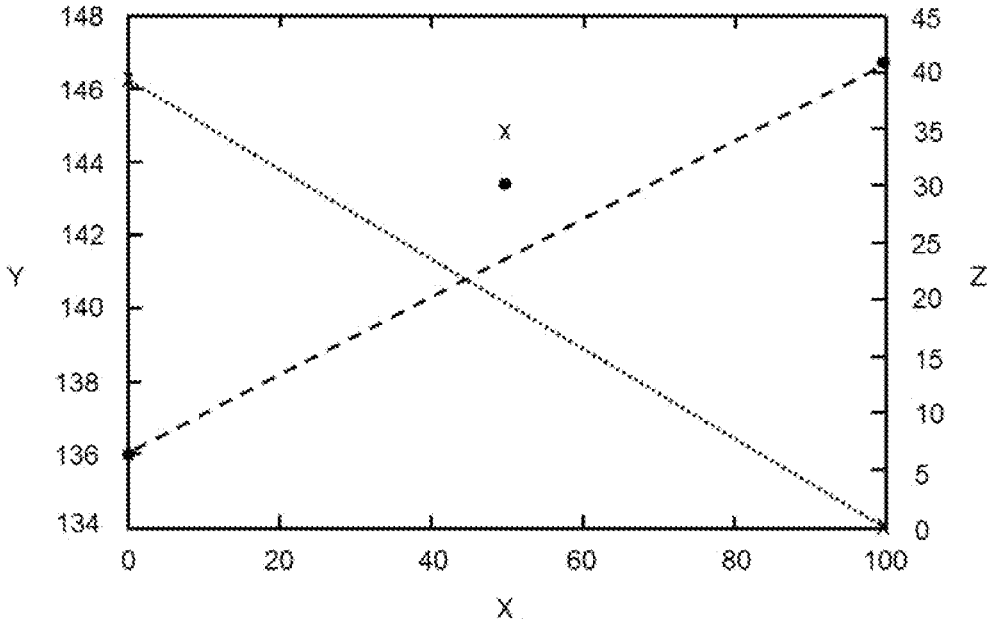

FIG. 2 shows results of the determination of the core weight of test bars (produced from mixtures 1.1, 1.2 and 1.3, cf. table 5, example 6) and results of the determination of residual strength after 3 hours of test bars (produced from mixtures 1.1, 1.2 and 1.3, cf. table 5, example 6).

Figure 3:
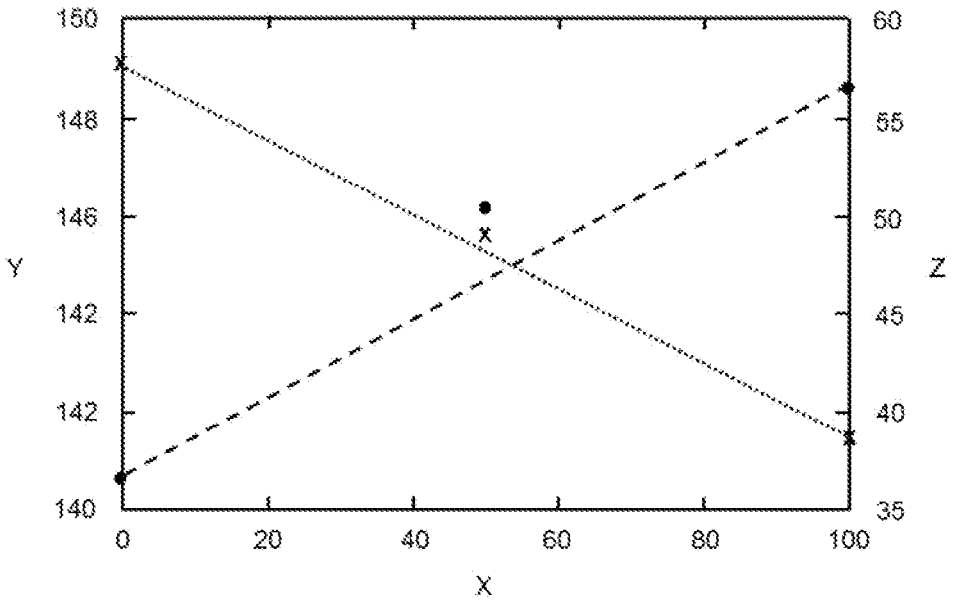
Figure 4:
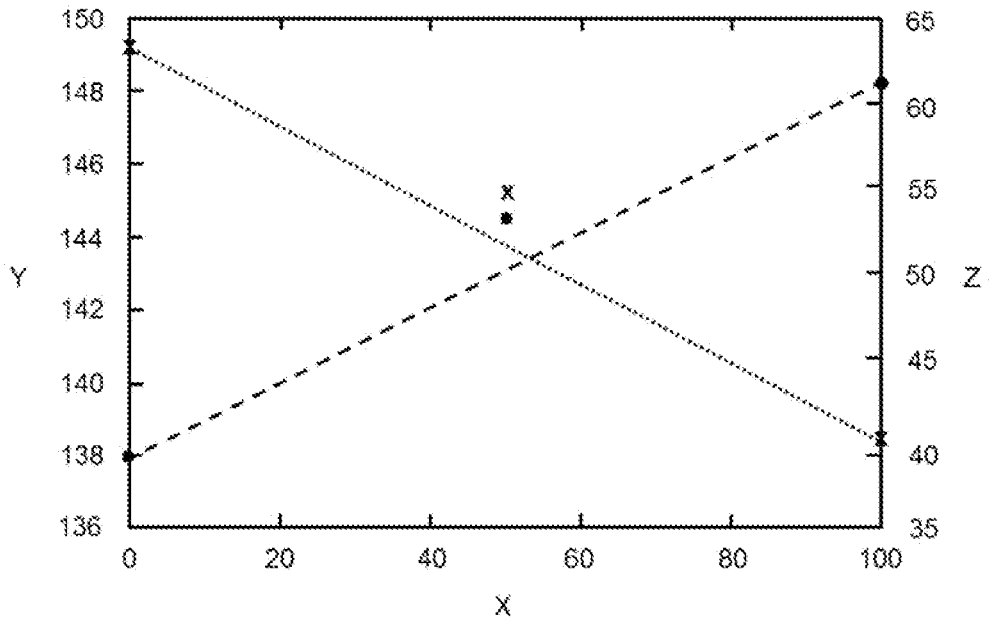
Figure 5:
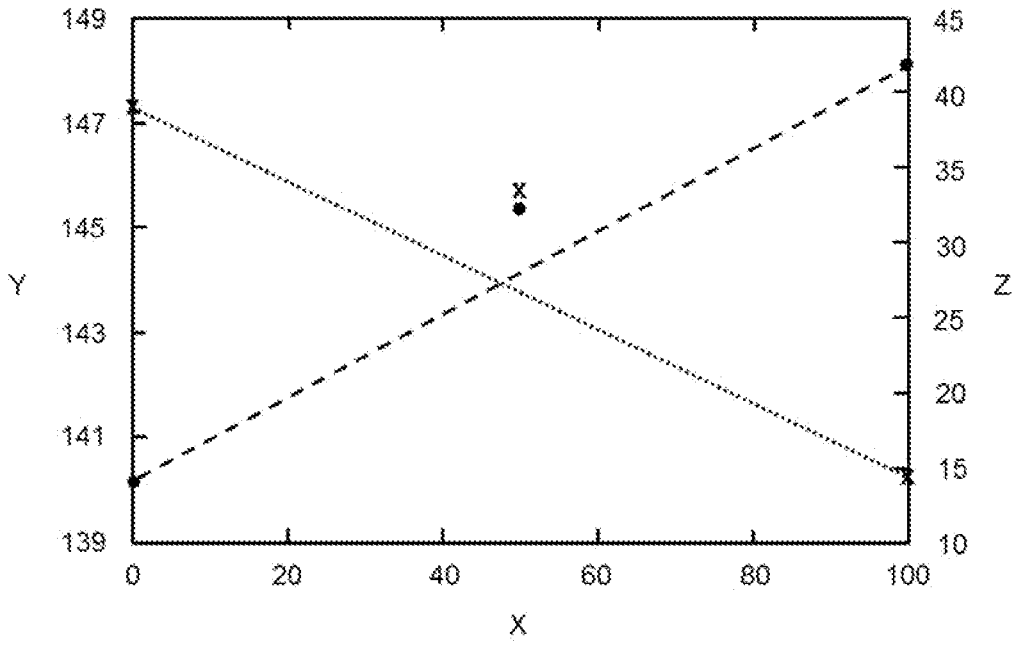

The X axis, here and in FIG. 3, FIG. 4 and FIG. 5, indicates the proportion of RW filler Q1 Plus in the total mass of Elkem Microsilica® 971 and RW filler Q1 Plus in the molding material mixture in percent. The Y axis, here and in FIG. 3, FIG. 4 and FIG. 5, indicates core weight in g, determined according to point 6.5 of example 6. The Z axis, here and in FIG. 3, FIG. 4 and FIG. 5, indicates residual strength after 3 hours in percent, determined according to point 6.7 of example 6.

The filled circles, here and in FIG. 3, FIG. 4 and FIG. 5, indicate experimentally ascertained measurements of the core weight of test bars (according to example 6). The dashed line, here and in FIG. 3, FIG. 4 and FIG. 5, illustrates the linear correlation expected by the person skilled in the art between the proportion of RW filler Q1 Plus in the total mass of Elkem Microsilica® 971 and RW filler Q1 Plus in the molding material mixture and core weight (linear combination based on the values for the pure materials).

The crosses, here and in FIG. 3, FIG. 4 and FIG. 5, represent experimentally ascertained values of residual strength after 3 hours (according to example 6). The dotted line, here and in FIG. 3, FIG. 4 and FIG. 5, illustrates the linear correlation expected by the person skilled in the art between the proportion of RW filler Q1 Plus in the total mass of Elkem Microsilica® 971 and RW filler Q1 Plus in the molding material mixture and moisture resistance (linear combination based on the values for the pure materials).

FIG. 3 shows results of the determination of the core weight of test bars (produced from mixtures 2.1, 2.2 and 2.3, cf. table 5, example 6) and results of the determination of residual strength after 3 hours of test bars (produced from mixtures 2.1, 2.2 and 2.3, cf. table 5, example 6).

FIG. 4 shows results of the determination of the core weight of test bars (produced from mixtures 3.1, 3.2 and 3.3, cf. table 5, example 6) and results of the determination of residual strength after 3 hours of test bars (produced from mixtures 3.1, 3.2 and 3.3, cf. table 5, example 6).

FIG. 5 shows results of the determination of the core weight of test bars (produced from mixtures 4.1, 4.2 and 4.3, cf. table 5, example 6) and results of the determination of residual strength after 3 hours of test bars (produced from mixtures 4.1, 4.2 and 4.3, cf. table 5, example 6).

Figure 6:
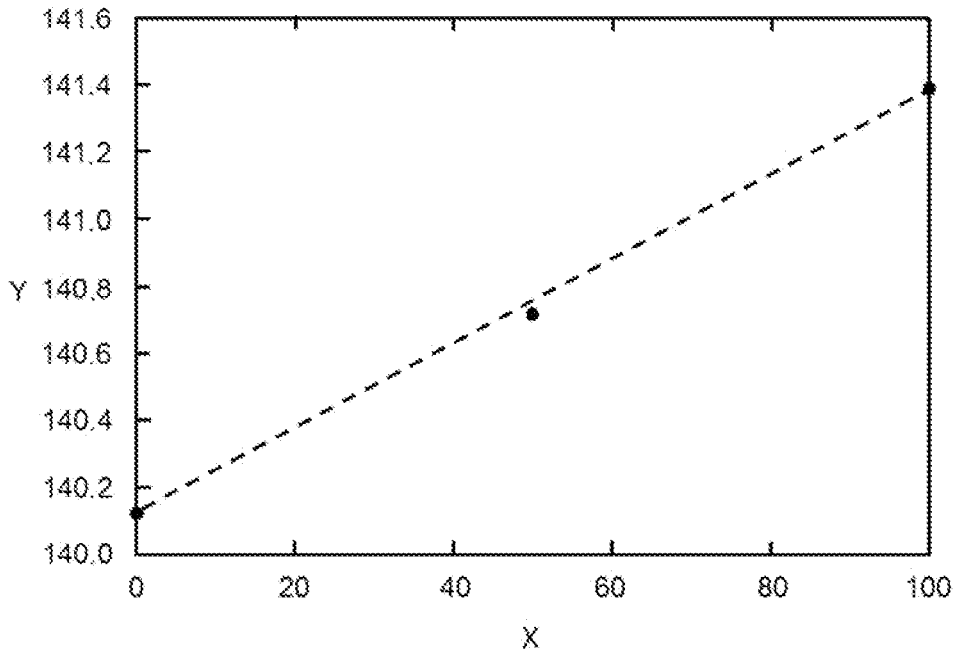

FIG. 6 shows results of the determination of core weight of test bars (produced from mixtures 5.1, 5.2 and 5.3, cf. table 5, example 6)

The X axis indicates the proportion of RW filler sieved in the total mass of Elkem Microsilica® 971 and RW filler sieved in the molding material mixture in percent. The Y axis indicates core weight determined according to point 6.5 of example 6 in g.

The filled circles indicate experimentally ascertained measurements of the core weight of test bars (according to example 6). The dashed line illustrates the linear correlation expected by the person skilled in the art between the proportion of RW filler sieved in the total mass of Elkem Microsilica® 971 and RW filler sieved in the molding material mixture and core weight (linear combination based on the values for the pure materials).

EXAMPLE 1

Determination of Particle Size Distribution by Means of Laser Scattering

The selection of the substances in this example is merely illustrative, and it is also possible to determine particle size distributions or medians of other particulate silicon dioxide species to be used in accordance with the invention by means of laser scattering according to the procedure in this example.

1.1 Sample Preparation

By way of example, particle size distributions of silica fume particles (CAS number: 65012-64-2) that are commercially available (from RW Silicium GmbH) and in particulate powder form from Si production, RW filler sieved ["RW-Füller gesiebt"], and from $ZrO_2$ production, RW filler Q1 Plus ["RW-Füller Q1 plus"], were determined experimentally by means of laser scattering.

In each case, about 1 teaspoon of the particulate silicon dioxide was admixed with about 100 mL of demineralized water, and the resultant mixture was stirred with a magnetic stirrer (IKAMAG RET) at a stirrer speed of 500 revolutions per minute for 30 seconds. Subsequently, an ultrasound probe (from Hielscher; model: UP200HT) preadjusted to 100% amplitude, equipped with the S26d7 sonotrode (from Hielscher), was immersed into the sample, and the sample was sonicated therewith. The sonication was continuous (not pulsed). For the silica fume particles examined from Si production, RW filler sieved, and from $ZrO_2$ production, RW filler Q1 plus, optimal sonication times of 300 seconds (for RW filler sieved) or 240 seconds (for RW filler Q1 Plus) were chosen, which had been ascertained beforehand as described in point 1.3 of example 1.

1.2 Laser Scattering Measurements

The measurements were conducted with a Horiba LA-960 instrument (LA-960 hereinafter). For the measurements, circulation speed was set to 6, stirrer speed to 8, data recording for the sample to 30 000, convergence factor to 15, the mode of distribution to volume, and refractive index (R) to 1.50-0.01 i (1.33 for demineralized water dispersion medium) and refractive index (B) to 1.50-0.01i (1.33 for demineralized water dispersion medium). Laser scattering measurements were conducted at room temperature (20° C. to 25° C.).

The measurement chamber of the LA-960 was filled to an extent of three quarters with demineralized water (maximum fill level). Then the stirrer was started at the set speed, the circulation was switched on and the water was degassed. Subsequently, a zero measurement was conducted with the parameters specified.

A disposable pipette was then used to take a 0.5-3.0 mL sample centrally from the sample prepared according to point 1.1 of example 1 immediately after the ultrasound treatment. Subsequently, the complete contents of the pipette were introduced into the measurement chamber, such that the transmittance of the red laser was between 80% and 90% and the transmittance of the blue laser was between 70% to 90%. Then the measurement was started. The measurements were evaluated in an automated manner on the basis of the parameters specified.

For the silica fume particles examined from Si production (RW filler sieved), a particle size distribution was ascertained with a median of 0.23 micrometer, rounded to the second post-decimal place.

For the silica fume particles examined from $ZrO_2$ production (RW filler Q1 Plus), a particle size distribution was ascertained with a median of 0.84 micrometer, rounded to the second post-decimal place.

1.3 Determination of Optimal Sonication Time

The optimal duration of ultrasound sonication, which is dependent on the type of sample, was ascertained by conducting a measurement series with different sonication times for each species of particulate silicon dioxide. This was done by extending the sonication time, starting from 10 seconds, by 10 seconds each time for every further sample, and determining the respective particle size distribution by means of laser scattering (LA-960) immediately after the end of sonication, as described in point 1.2 of example 1. With increasing duration of sonication, the median ascertained in the particle size distribution fell at first, until it ultimately rose again at longer sonication times. For the ultrasound sonications described in point 1.1 of example 1, the sonication time chosen was that at which, in these measurement series, the lowest median of the particle size distribution was determined for the respective particle species; this sonication time is the "optimal" sonication time.

EXAMPLE 2

Production of Test Bars

This example describes, by way of example, the production of test bars (moldings); the dimensions of the test bars are merely by way of example, and the selection of the substances used is also merely illustrative of further substances to be used in accordance with the invention.

2.1 Production of Molding Material Mixtures

For the purposes of this example, RW filler (having a particle size distribution with a median of 0.23 micrometer, rounded to the second post-decimal place, determined by means of light scattering; by way of example of a particulate synthetic amorphous silicon dioxide to be used in accordance with the invention having a particle size distribution with a median in the range from 0.1 to 0.4 micrometer, determined by means of laser scattering) and Q1 Plus (having a particle size distribution with a median of 0.84 micrometer, rounded to the second post-decimal place, determined by means of light scattering; by way of example of a particulate amorphous silicon dioxide having a particle size distribution with a median in the range from 0.7 to 1.5 micrometers, determined by means of laser scattering) were mixed together in dry form; the amounts added are apparent from table 1. The resulting pulverulent mixture of RW filler sieved and RW filler Q1 Plus was mixed manually with H31 sand (quartz sand; from Quarzwerke GmbH, AFS grain fineness number 46).

Then a water glass-based liquid binder having a solids content of about 36.2% by weight, a molar modulus of about 2.1 and an $Na_2O$ to $K_2O$ ratio (molar) of about 7.7, and containing 2.0% by weight of HOESCH EHS 40 (from Hoesch; ethylhexyl sulfate, active content about 40.0% to 44.0%; CAS No. 126-92-1) was added, and all components were mixed with one another in a bull mixer (model: RN 10/20, from Morek Multiserw) at 220 revolutions per minute for 120 s.

By way of example, noninventive and inventive mixtures were produced with the proportions by weight of the components used that are specified in table 1.

TABLE 1

| Mixture no. | Addition of sand (parts by weight) | Addition of binder (parts by weight) | Addition of RW filler sieved (parts by weight) | Addition of RW filler Q1 Plus (parts by weight) | Proportion of RW filler sieved in the total amount of RW filler sieved and RW filler Q1 Plus in the molding material mixture (percent) |
|---|---|---|---|---|---|
| 1 | 100 | 2.2 | 0.80 | 0.00 | 100 |
| 2 | 100 | 2.2 | 0.76 | 0.04 | 95 |
| 3 | 100 | 2.2 | 0.72 | 0.08 | 90 |
| 4 | 100 | 2.2 | 0.64 | 0.16 | 80 |
| 5 | 100 | 2.2 | 0.60 | 0.20 | 75 |
| 6 | 100 | 2.2 | 0.48 | 0.32 | 60 |
| 7 | 100 | 2.2 | 0.40 | 0.40 | 50 |
| 8 | 100 | 2.2 | 0.32 | 0.48 | 40 |
| 9 | 100 | 2.2 | 0.20 | 0.60 | 25 |
| 10 | 100 | 2.2 | 0.16 | 0.64 | 20 |
| 11 | 100 | 2.2 | 0.08 | 0.72 | 10 |
| 12 | 100 | 2.2 | 0.04 | 0.76 | 5 |
| 13 | 100 | 2.2 | 0.00 | 0.80 | 0 |

2.2 Production of Test Bars

Molding material mixtures produced according to point 2.1 of example 2 were formed to test bars having the dimensions of 22.4 mm×22.4 mm×185 mm. For this purpose, the respective molding material mixtures were introduced with compressed air (4 bar) and a shooting time of 3 seconds into a mold for test bars having a temperature of 180° C. Subsequently, the test bars were hot-cured at 180° C. for 30 seconds, while additionally being aerated with heated ambient air at an aeration pressure of 2 bar and an aeration and aeration hose temperature of 180° C. Thereafter, the mold was opened, and the cured test bars were removed and stored for cooling.

EXAMPLE 3

Determination of Core Weight

This example describes, merely by way of example, the determination of the core weight of test bars (moldings).

Test bars with mixture numbers 1, 2, 3, 5, 7, 9, 11, 12, 13 that had been produced according to example 2, after a cooling time of about one hour, were weighed on a laboratory balance. Results are shown in table 2, with the respective core weight figure corresponding to an average from 9 individual measurements. The mixture number in table 2 corresponds to the mixture number in table 1, such that an identical mixture number in this respect means an identical composition of the molding material mixture.

TABLE 2

| Mixture no. | Core weight (grams) |
|---|---|
| 1 | 148.3 |
| 2 | 149.2 |
| 3 | 149.8 |
| 5 | 151.8 |
| 7 | 154.0 |
| 9 | 155.9 |
| 11 | 156.6 |
| 12 | 157.0 |
| 13 | 157.3 |

EXAMPLE 4

Determination of Moisture Resistance

This example describes, merely by way of example, the determination of the moisture resistance (moisture stability) of test bars (moldings).

4.1 Determination of One-Hour Strength

Test bars that have been produced according to example 2 (mixture numbers: 1, 3, 4, 5, 6, 7, 8, 9, 10, 11, 13), after a cooling time of one hour, were introduced into a Georg Fischer strength tester, equipped with a 3-point bending device (from Morek Multiserw), and the force that led to fracture of the test bar was measured. The value read off (in N/cm$^2$) indicates the one-hour strength.

4.2 Determination of Absolute Residual Strength After 22 h in a Climate-Controlled Cabinet Test bars produced according to example 2 (mixture numbers according to example 4.1), after a cooling time of one hour, were stored for 22 hours under controlled conditions of 30° C. and 75% relative humidity in a climate-controlled cabinet (VC 0034, from Vötsch).

Thereafter, absolute residual strength was determined by introducing the respective test bars into a Georg Fischer strength tester, equipped with a 3-point bending device (from Morek Multiserw), and measuring the force that led to fracture of the test bars. The value read off (in N/cm$^2$) indicates the absolute residual strength. For cores that had already fractured before the 22 h had elapsed, an absolute residual strength of 0 N/cm$^2$ was assumed.

4.3 Determination of Moisture Resistance

For the determination of moisture resistance, for each mixture number, an average of a total of 6 measurements of absolute residual strength (example 4.2) was formed and divided by the average of 3 measurements of one-hour strength (example 4.1). The value thus obtained was multiplied by 100%; the result is the moisture resistance. Values of moisture resistance ascertained in this way are reported in table 3. The mixture number in table 3 corresponds to the mixture number in table 1, such that an identical mixture number means an identical composition of the molding material mixture.

TABLE 3

| Mixture no. | Moisture resistance (percent) |
|---|---|
| 1 | 42 |
| 3 | 41 |
| 4 | 37 |
| 5 | 42 |
| 6 | 40 |
| 7 | 36 |
| 8 | 36 |
| 9 | 29 |
| 10 | 29 |
| 11 | 24 |
| 13 | 4 |

EXAMPLE 5

Synergistic Effect

The results from example 3, table 2, and example 4, table 3, are summarized hereinafter in an overview table 4. The overview table 4 is accompanied by a diagram according to FIG. 1 created from the table.

TABLE 4

| Mixture no. | Proportion of RW filler sieved in the total amount of RW filler sieved and RW filler Q1 Plus in the molding material mixture (percent) | Core weight (grams) | Moisture resistance (percent) |
|---|---|---|---|
| 1 | 100 | 148.3 | 42 |
| 2 | 95 | 149.2 | — |
| 3 | 90 | 149.8 | 41 |
| 4 | 80 | — | 37 |
| 5 | 75 | 151.8 | 42 |
| 6 | 60 | — | 40 |
| 7 | 50 | 154.0 | 36 |
| 8 | 40 | — | 36 |
| 9 | 25 | 155.9 | 29 |

TABLE 4-continued

| Mixture no. | Proportion of RW filler sieved in the total amount of RW filler sieved and RW filler Q1 Plus in the molding material mixture (percent) | Core weight (grams) | Moisture resistance (percent) |
|---|---|---|---|
| 10 | 20 | — | 29 |
| 11 | 10 | 156.6 | 24 |
| 12 | 5 | 157.0 | — |
| 13 | 0 | 157.3 | 4 |

It is apparent from overview table 4 and the accompanying FIG. 1 that, generally, for a ratio of the total mass of particulate amorphous silicon dioxide having a particle size distribution with a median in the range from 0.7 to 1.5 μm, determined by means of laser scattering, namely the material RW filler Q1 Plus (particle size distribution with a median of 0.84 μm rounded to the second post-decimal place), to the total mass of particulate synthetic amorphous silicon dioxide in a particle size distribution with a median in the range from 0.1 to 0.4 μm, determined by means of laser scattering, namely RW filler sieved (particle size distribution with a median of 0.23 μm rounded to the second post-decimal place), advantageous values are in the range from 20:1 to 1:20, since there is a significant double synergistic effect within this range, which is manifested in an unexpectedly high (synergistically elevated) moisture resistance and simultaneously an unexpectedly high (synergistically elevated) relative molding weight (core weight here) (the respective measurements are each higher than the values expected). Preferably, the values are in the range from 5:1 to 1:20, more preferably in the range from 3:1 to 1:20, especially preferably in the range from 2:1 to 1:20, most preferably in the range from 1.5:1 to 1:20. Particular preference is therefore given to a proportion of at least 40% by weight of the particulate synthetic amorphous silicon dioxide having a particle size distribution with a median in the range from 0.1 to 0.4 μm, determined by means of laser scattering (in the example, this is RW filler sieved having a particle size distribution with a median of 0.23 μm rounded to the second post-decimal place), based on the total mass of the two types used.

Corresponding products thus firstly ensure high storage stability (especially stability against the action of moisture) and secondly high compaction of the formed molding material mixture, which leads to a high-quality surface containing few defects in the hot-cured molding obtained therefrom, which in turn leads to a high-quality surface containing few defects in metallic cast parts produced in the inventive manner that has come into contact with the hot-cured molding in the casting operation.

EXAMPLE 6

Comparative Studies

6.1 General Pointers for Understanding of the Studies

This example relates to comparative studies on a total of 15 different molding material mixtures specified in table 5. More particularly, inventive experiments were compared with noninventive experiments that were conducted in accordance with WO2009/056320 A1.

Studies in accordance with the invention are those with molding material mixtures 1.3, 2.3, 3.3 and 4.3 according to table 5. All other molding material mixtures are not in accordance with the invention.

In all molding material mixtures examined, the same quartz sand and the same alkali metal water glass were used in equal amounts in each case; cf. table 5 and the details of the composition of the alkali metal water glass specified in the accompanying footnote 1.

Particulate synthetic amorphous silicon dioxide having a particle size distribution with a median in the range from 0.1 to 0.4 μm, determined by means of laser scattering, that was used in the total of 10 molding material mixtures 1.1, 1.3, 2.1, 2.3, 3.1, 3.3, 4.1, 4.3, 5.1 and 5.3 was Elkem Microsilica® 971 U. As stated in footnote 5 relating to table 5, the median of the particle size distribution (rounded to the second post-decimal place) was 0.20 μm, according to the determination method from example 1. The optimal sonication time (cf. point 1.3 in example 1) ascertained was 1020 seconds.

In the total of eight molding material mixtures 1.2, 1.3, 2.2, 2.3, 3.2, 3.3, 4.2 and 4.3, the particulate amorphous silicon dioxide having a particle size distribution with a median in the range from 0.7 to 1.5 μm, determined by means of laser scattering, that was used was an RW filler Q1 Plus; according to example 1.2, this material had a particle size distribution with a median of 0.84 micrometer rounded to the second post-decimal place.

In the two molding material mixtures 5.2 and 5.3 (alongside Elkem Microsilica® 971 U in molding material mixture 5.3), the particulate synthetic amorphous silicon dioxide having a particle size distribution with a median in the range from 0.1 to 0.4 μm, determined by means of laser scattering, that was used was an RW filler sieved; according to example 1.2, this material had a particle size distribution with a median of 0.23 micrometer rounded to the second post-decimal place.

No surfactant was used in molding material mixtures 1.1 to 1.3; a total of three different surfactants were used in the further molding material mixtures, always in the same amounts. For physical details of the surfactants, reference is made to footnotes 2, 3 and 4 of table 5.

Studies were conducted on 5 groups of molding material mixtures (1.1 to 1.3, 2.1 to 2.3, 3.1 to 3.3, 4.1 to 4.3 and 5.1 to 5.3):

- The first of the studies in each group (molding material mixtures 1.1, 2.1, 3.1, 4.1, 5.1) in each case relates to a molding material mixture comprising solely Elkem Microsilica® 971 U as the only particulate synthetic amorphous silicon dioxide.
- The second of the studies in each group relates in each case to a molding material mixture without Elkem Microsilica® 971 U, but with either RW filler Q1 Plus (molding material mixtures 1.2, 2.2, 3.2, 4.2) or RW filler sieved (molding material mixture 5.2) as the only particulate synthetic amorphous silicon dioxide.
- The third of the studies in each group relates in each case to a molding material mixture with Elkem Microsilica® 971 U and additionally either RW filler Q1 Plus (molding material mixtures 1.3, 2.3, 3.3, 4.3) or RW filler sieved (molding material mixture 5.3).

In molding material mixtures 1.3, 2.3, 3.3, 4.3, two species of particulate synthetic amorphous silicon dioxide were used in each case, of which one species (Elkem Microsilica 971 U) had a particle size distribution with a median in the range from 0.1 to 0.4 μm, determined by means of laser scattering, and the other species (RW filler Q1

Plus) a particle size distribution with a median in the range from 0.7 to 1.5 μm, determined by means of laser scattering.

In molding material mixture 5.3, two species of particulate synthetic amorphous silicon dioxide were used, each of which has a particle size distribution with a median in the range from 0.1 to 0.4 μm, determined by means of laser scattering.

6.2 Production of the Molding Material Mixtures

For production of the molding material mixtures defined in table 5, the alkali metal water glass and any surfactant (surface-active substance) were added to the initial charge of H32 quartz sand. The mixture was stirred at 200 revolutions per minute in a bull mixer (model: RN 10/20, from Morek Multiserw) for 1 minute. Thereafter, the particulate amorphous silicon dioxide was added and the resulting mixture was then stirred in the bull mixer for a further minute.

of molding material mixtures 5.1 to 5.3 were used only in the study according to 6.5 (determination of core weight).

6.4 Determination of Heat Resistance

Immediately after removal from the mold, test bars produced according to point 6.3 were introduced into a Georg Fischer strength tester, equipped with a 3-point bending device (from Morek Multiserw). 10 seconds after the mold had been opened, the force that led to fracture of the test bars was measured. The value read off (in $N/cm^2$) indicates the hot strength. Table 6 gives the results of the measurements of hot strength; the values reported are medians from 3 measurements in each case.

6.5 Determination of Core Weight

Test bars produced according to point 6.3, after a cooling time of about one hour, were weighed on a laboratory

TABLE 5

| Molding material mixture | H32 quartz sand PW[8] | Alkali metal water glass[1] PW[8] | Surfactant Name | Surfactant PW[8] | Particulate amorphous silicon dioxide Elkem Microsilica ® 971 U[5] PW[8] | Further particulate amorphous silicon dioxide Name | Further particulate amorphous silicon dioxide PW[8] | Inventive yes/no |
|---|---|---|---|---|---|---|---|---|
| 1.1 | 100 | 2.0 | — | — | 0.50 | — | — | no |
| 1.2 | 100 | 2.0 | — | — | — | Q1 Plus[6] | 0.50 | no |
| 1.3 | 100 | 2.0 | — | — | 0.25 | Q1 Plus[6] | 0.25 | yes |
| 2.1 | 100 | 2.0 | EHS[2] | 0.05 | 0.50 | — | — | no |
| 2.2 | 100 | 2.0 | EHS[2] | 0.05 | — | Q1 Plus[6] | 0.50 | no |
| 2.3 | 100 | 2.0 | EHS[2] | 0.05 | 0.25 | Q1 Plus[6] | 0.25 | yes |
| 3.1 | 100 | 2.0 | Melpers[3] | 0.05 | 0.50 | — | — | no |
| 3.2 | 100 | 2.0 | Melpers[3] | 0.05 | — | Q1 Plus[6] | 0.50 | no |
| 3.3 | 100 | 2.0 | Melpers[3] | 0.05 | 0.25 | Q1 Plus[6] | 0.25 | yes |
| 4.1 | 100 | 2.0 | SOS[4] | 0.05 | 0.50 | — | — | no |
| 4.2 | 100 | 2.0 | SOS[4] | 0.05 | — | Q1 Plus[6] | 0.50 | no |
| 4.3 | 100 | 2.0 | SOS[4] | 0.05 | 0.25 | Q1 Plus[6] | 0.25 | yes |
| 5.1 | 100 | 2.0 | SOS[4] | 0.05 | 0.50 | — | — | no |
| 5.2 | 100 | 2.0 | SOS[4] | 0.05 | | RW filler sieved[7] | 0.50 | no |
| 5.3 | 100 | 2.0 | SOS[4] | 0.05 | 0.25 | RW filler sieved[7] | 0.25 | no |

[1]Alkali metal water glass with molar modulus ($SiO_2$:$M_2O$ with M = Na, K) of about 2.2; about 36.2% by weight of solids and a molar ratio of $Na_2O$ to $K_2O$ of about 3.6:1.0.
[2]2-Ethylhexyl sulfate in water (from Hoesch)
[3]Melpers ® VP 4547/240 L (modified polyacrylate in water, from BASF)
[4]Texapon ® 842 UP (sodium octylsulfate in water, from BASF)
[5]Elkem Microsilica ® 971 U (pyrogenic silica; production in an arc furnace; median of particle size distribution determined by means of laser scattering 0.20 micrometer, determination according to example 1).
[6]RW filler Q1 Plus (from RW Silicium GmbH, silica fume from $ZrO_2$ production; median of particle size distribution determined by means of laser scattering 0.84 micrometer, determination according to example 1).
[7]RW filler sieved (from RW Silicium GmbH, silica fume from $SiO_2$ production; median of particle size distribution determined by means of laser scattering 0.23 micrometer, determination according to example 1).
[8]PW means part(s) by weight 6.3 Production of Test Bars Molding material mixtures of the respective compositions specified in table 5 that had been produced according to point 6.2 were formed to test bars having the dimensions of 22.4 mm×22.4 mm×185 mm. For this purpose, the respective molding material mixtures were introduced with compressed air (2 bar) into a mold for test bars at a temperature of 180° C., and remain in the mold for a further 50 seconds. For acceleration of the curing of the mixtures, hot air (3 bar, 150° C.) was passed through the mold for the last 20 seconds. Thereafter, the mold was opened and the test bar (22.4 mm×22.4 mm×185 mm) was removed.

The test bars were used in studies according to points 6.4 to 6.7 below; the noninventive test bars based on the group balance. Results are shown in table 6, with the respective core weight figure corresponding to a median from 9 individual measurements.

6.6. Determination of One-Hour Strength

Test bars produced according to point 6.3, after removal from the mold, were placed horizontally on a frame such that they rested on the frame only in the region of the two ends of their longest extent, and the test bars spanned a range of about 16 cm without contact between the contact surfaces. After a cooling time of 1 hour after removal from the mold, the test bars were introduced into a Georg Fischer strength tester, equipped with a 3-point bending device (from Morek Multiserw), and the force that led to fracture of the test bars was measured. The value read off (in $N/cm^2$) indicates the one-hour strength. Results are shown in table 6, with the values reported being medians from 3 individual measurements in each case.

6.7 Determination of Residual Strength After 3 Hours and Relative Residual Strength After 3 Hours Test bars produced according to point 6.3, after removal from the mold, were cooled down under ambient conditions in the laboratory for one hour as described in point 6.6, and then, mounted on the same frame, stored under controlled conditions of 30° C. and 75% relative humidity in a climate-controlled cabinet (VC 0034, from \kitsch) for 3 hours (3 h).

Thereafter, (absolute) residual strength after 3 hours was determined by placing the respective test bars in a Georg Fischer strength tester, equipped with a 3-point bending device (from Morek Multiserw), and measuring the force that led to fracture of the test bars. The value read off (in $N/cm^2$) indicates the (absolute) residual strength after 3 hours.

For cores that had already fractured before the 3 hours had elapsed, an absolute residual strength of 0 $N/cm^2$ was noted. Results are shown in table 6, with the values reported being medians from 3 individual measurements in each case.

For the determination of relative residual strength after 3 hours, the values of absolute residual strength after 3 hours were each divided by the corresponding values of one-hour strength. The values thus obtained were multiplied by 100%; the respective result is the relative residual strength after 3 hours. The results are reported in table 6.

6.8 RESULTS

Selected results of the measurements from 6.4 to 6.7 are shown in FIGS. 2 to 6 (see the above elucidations for the figures). The results of all measurements from 6.4 to 6.7 are additionally summarized in table 6; for reasons of clarity, measurements therein are rounded to the first post-decimal place. The numbers of the molding material mixtures in table 6 correspond to those in table 5.

TABLE 6

| Molding material mixture | Core weight [g] | Hot strength [$N/cm^2$] | One-hour strength [$N/cm^2$] | Residual strength after 3 h (30° C./ 75% RH) [$N/cm^2$] | Relative residual strength after 3 h (30° C./ 75% RH) [$N/cm^2$] |
|---|---|---|---|---|---|
| 1.1 | 136.0 | 112 | 257 | 101 | 39 |
| 1.2 | 146.7 | 88 | 317 | 0 | 0 |
| 1.3 | 143.4 | 112 | 275 | 95 | 35 |
| 2.1 | 140.6 | 135 | 341 | 197 | 58 |
| 2.2 | 148.7 | 141 | 432 | 167 | 39 |
| 2.3 | 146.2 | 140 | 402 | 197 | 49 |
| 3.1 | 137.9 | 146 | 378 | 239 | 63 |
| 3.2 | 148.2 | 153 | 461 | 185 | 40 |
| 3.3 | 144.5 | 158 | 426 | 233 | 55 |
| 4.1 | 140.1 | 141 | 317 | 124 | 39 |
| 4.2 | 148.1 | 146 | 411 | 59 | 14 |
| 4.3 | 145.4 | 123 | 356 | 119 | 33 |
| 5.1 | 140.1 | — | — | — | — |
| 5.2 | 141.4 | — | — | — | — |
| 5.3 | 140.7 | — | — | — | — |

It is apparent from table 6 and from FIGS. 2 to 5 corresponding to the groups of 3 molding material mixtures (1.1-1.3 to 4.1-4.3) that, in each case of joint use of Elkem Microsilica® 971 U (particulate amorphous silicon dioxide having a particle size distribution with a median of 0.20 micrometer, i.e. in the range from 0.1 to 0.4 μm, determined by means of laser scattering) and of RW filler Q1 Plus (particulate amorphous silicon dioxide having a particle size distribution with a median of 0.84 micrometer, i.e. in the range from 0.7 to 1.5 μm, determined by means of laser scattering), the core weight of the test bars produced is surprisingly high, namely higher than the linear combination of the values for test bars comprising Elkem Microsilica® 971 U alone or RW filler Q1 Plus alone (linear combination shown by the dashed line in each case).

A significant double synergistic effect is found in each case, which is manifested in the unexpectedly high (synergistically increased) relative shaped body weight (core weight) and a simultaneously unexpectedly high (synergistically increased) relative residual strength after 3 hours.

It is apparent from table 6 and from FIG. 6 corresponding to the group of 3 molding material mixtures 5.1-5.3 that, for molding material mixture 5.3, i.e. in the case of joint use of Elkem Microsilica® 971 U (particulate amorphous silicon dioxide having a particle size distribution with a median of 0.20 micrometer, i.e. in the range from 0.1 to 0.4 μm, determined by means of laser scattering) and of RW filler sieved (particulate amorphous silicon dioxide having a particle size distribution with a median of 0.23 micrometer, i.e. likewise in the range from 0.1 to 0.4 μm, determined by means of laser scattering), the core weight of the test bars produced is not higher than the linear combination of the values for test bars comprising Elkem Microsilica® 971 U alone (molding material mixture 5.1) or RW filler sieved alone (molding material mixture 5.2) (linear combination shown by the dashed line in each case); no double synergistic effect can be observed.

The surprising advantages of the invention are especially apparent by comparison with experiments relating to the noninventive molding material mixtures 1.1, 2.1, 3.1, 4.1, 5.1 that were conducted in accordance with WO2009/056320 A1. The core weight of molding material mixtures of the invention is significantly higher in each case; at the same time, relative residual strength after 3 hours is not reduced to a degree of relevance for industrial practice (double synergistic effect).

We claim:

1. A process for producing a hot-cured molding having increased moisture resistance, having the following steps:

(i) producing a molding material mixture by mixing together at least the following constituents:

refractory mold base material having an AFS grain fineness number in the range from 30 to 100, particulate amorphous silicon dioxide, wherein the particulate amorphous silicon dioxide has a particle size distribution with a median in the range from 0.7 to 1.5 μm, determined by means of laser scattering, and water glass, (ii) forming the molding material mixture, and (iii) hot curing the formed molding material mixture, so as to result in the molding, wherein the constituents of the molding material mixture are additionally mixed with a particulate material as additive comprising, as its sole constituent or as one of multiple constituents, a particulate synthetic amorphous silicon dioxide, wherein the particulate synthetic amorphous silicon dioxide has a particle size distribution with a median in the range from 0.1 to 0.4 μm, determined by means of laser scattering.

2. The process as claimed in claim 1, wherein the molding material mixture is produced by creating a solid-state mixture or suspension by mixing at least the following solid constituents:

the particulate amorphous silicon dioxide, and the particulate material as additive comprising, as its sole constituent or as one of multiple constituents, the particulate synthetic amorphous silicon dioxide, wherein the solid-state mixture or suspension created is mixed with the further constituents of the molding material mixture.

3. A mixture for use in a process as claimed in claim 1, at least comprising the following solid constituents:

the particulate amorphous silicon dioxide, and the particulate material as additive comprising, as its sole constituent or as one of multiple constituents, the particulate synthetic amorphous silicon dioxide, wherein the mixture is a solid-state mixture or a suspension of solid constituents in a liquid carrier medium.

4. The mixture as claimed in claim 3, at least comprising the following constituents:

refractory mold base material having an AFS grain fineness number in the range from 30 to 100, the particulate amorphous silicon dioxide, water glass, and the particulate material as additive comprising, as its sole constituent or as one of multiple constituents, the particulate synthetic amorphous silicon dioxide.

5. The mixture as claimed in claim 4, wherein, in the mixture, a proportion of the particulate synthetic amorphous silicon dioxide is less than 2% by weight, based on total mass of the mixture, and/or a proportion of the particulate amorphous silicon dioxide is less than 2% by weight, based on total mass of the mixture, and/or a total proportion of the particulate synthetic amorphous silicon dioxide and the particulate amorphous silicon dioxide is less than 2% by weight, based on total mass of the mixture, and/or a total proportion of amorphous silicon dioxide is less than 2% by weight, based on the total mass of the mixture.

6. The mixture as claimed in claim 3, producible by a process comprising the following steps:

(i) providing or producing a separate amount of the particulate amorphous silicon dioxide, (ii) providing or producing an amount of the particulate material as additive comprising, as its sole constituent or as one of multiple constituents, the particulate synthetic amorphous silicon dioxide, (iii) mixing the amounts provided or produced in steps (i) and (ii).

7. The mixture as claimed in claim 3, wherein the ratio of total mass of the particulate amorphous silicon dioxide to total mass of the particulate synthetic amorphous silicon dioxide is in the range from 20:1 to 1:20.

8. The mixture as claimed in claim 3 for use in the production of casting molds or cores for metal processing.

9. The mixture as claimed in claim 3, wherein the particulate synthetic amorphous silicon dioxide and/or the particulate amorphous silicon dioxide is selected or are independently selected from the group consisting of particulate synthetic amorphous silicon dioxide containing silicon dioxide in a proportion of at least 90% by weight, based on total mass of the particulate synthetic amorphous silicon dioxide, and at least carbon as secondary constituent;

particulate synthetic amorphous silicon dioxide comprising oxidic zirconium as secondary constituent particulate synthetic amorphous silicon dioxide producible by oxidizing metallic silicon by means of an oxygenous gas;

particulate synthetic amorphous silicon dioxide producible by quenching a silicon dioxide melt and mixtures thereof.

10. The mixture as claimed in claim 3, wherein the particulate synthetic amorphous silicon dioxide contains silicon dioxide in a proportion of at least 90% by weight based on total mass of the particulate synthetic amorphous silicon dioxide, and at least carbon as secondary constituent;

and/or the particulate amorphous silicon dioxide is a particulate synthetic amorphous silicon dioxide comprising oxidic zirconium as secondary constituent.

11. The mixture as claimed in claim 3, wherein one or more additional components are added to the molding material mixture, wherein said one or more additional components are selected from the group consisting of: barium sulfate, oxidic boron compounds, graphite, carbohydrates, lithium compounds, phosphorus compounds, hollow microbeads, molybdenum sulfide, lubricants in platelet form, surfactants, organosilicon compounds, alumina and alumina-containing compounds.

12. The mixture as claimed in claim 3, wherein the particulate synthetic amorphous silicon dioxide and/or the particulate amorphous silicon dioxide has pozzolanic activity.

13. The mixture as claimed in claim 3, wherein activity of Ra226 in the molding material mixture is not more than 1 Bq/g.

14. A kit for production of the mixture as claimed in claim 3, at least comprising as or in a first constituent of the kit, an amount of the particulate amorphous silicon dioxide, as or in a second constituent of the kit, an amount of the particulate synthetic amorphous silicon dioxide, wherein the first and second constituents of the kit are arranged in spatial separation from one another.

15. The process as claimed in claim 1, wherein the particulate synthetic amorphous silicon dioxide and/or the particulate amorphous silicon dioxide is selected or are independently selected from the group consisting of particulate synthetic amorphous silicon dioxide containing silicon dioxide in a proportion of at least 90% by weight, based on total mass of the particulate synthetic amorphous silicon dioxide, and at least carbon as secondary constituent;

particulate synthetic amorphous silicon dioxide comprising oxidic zirconium as secondary constituent particulate synthetic amorphous silicon dioxide producible by oxidizing metallic silicon by means of an oxygenous gas;

particulate synthetic amorphous silicon dioxide producible by quenching a silicon dioxide melt and mixtures thereof.

16. The process as claimed in claim 1, wherein the particulate synthetic amorphous silicon dioxide contains silicon dioxide in a proportion of at least 90% by weight based on total mass of the particulate synthetic amorphous silicon dioxide, and at least carbon as secondary constituent;

and/or the particulate amorphous silicon dioxide is a particulate synthetic amorphous silicon dioxide comprising oxidic zirconium as secondary constituent.

17. The process as claimed in claim 1, wherein one or more additional components are added to the molding material mixture, wherein said one or more additional components are selected from the group consisting of: barium sulfate, oxidic boron compounds, graphite, carbohydrates, lithium compounds, phosphorus compounds, hollow microbeads, molybdenum sulfide, lubricants in platelet form, surfactants, organosilicon compounds, alumina and alumina-containing compounds.

18. The process as claimed in claim 1, wherein the particulate synthetic amorphous silicon dioxide and/or the particulate amorphous silicon dioxide has pozzolanic activity.

19. The process as claimed in claim 1, wherein activity of Ra226 in the molding material mixture is not more than 1 Bq/g.

* * * * *